US006529693B2

(12) United States Patent
Tomizawa et al.

(10) Patent No.: US 6,529,693 B2
(45) Date of Patent: Mar. 4, 2003

(54) IMAGE FORMING SYSTEM FOR CONTROLLING THE AMOUNT OF TONER DEPOSITED ON A PHOTOSENSITIVE DRUM BASED ON ENVIRONMENTAL CONDITIONS

(75) Inventors: Takeshi Tomizawa, Numazu (JP); Masahiro Inoue, Mishima (JP); Haruhiko Omata, Susono (JP); Yuji Bessho, Shizuoka-ken (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/382,407

(22) Filed: Aug. 25, 1999

(65) Prior Publication Data

US 2002/0018659 A1 Feb. 14, 2002

(30) Foreign Application Priority Data

| | | |
|---|---|---|
| Aug. 28, 1998 | (JP) | 10-259347 |
| Aug. 28, 1998 | (JP) | 10-259349 |
| Dec. 28, 1998 | (JP) | 10-372978 |
| Feb. 10, 1999 | (JP) | 11-033436 |

(51) Int. Cl.[7] ..... G03G 15/00
(52) U.S. Cl. ..... 399/44; 399/45; 399/66
(58) Field of Search ..... 399/44, 66, 45, 399/94, 46, 60

(56) References Cited

U.S. PATENT DOCUMENTS 5,983,044 A * 11/1999 Kodama et al. ..... 399/49
6,223,004 B1 * 4/2001 Kodama ..... 399/44

FOREIGN PATENT DOCUMENTS

JP 8-98048 4/1996

* cited by examiner

*Primary Examiner*—Quana M. Grainger
(74) *Attorney, Agent, or Firm*—Fitzpatrick, Cella, Harper & Scinto

(57) ABSTRACT

An image forming apparatus including, an image bearing member, an image forming device for forming a toner image on the image bearing member, a transfer device for electrostatically transferring the toner image formed by the image forming device on the image bearing member to a transfer material, an detector for detecting temperature and humidity in a main body of the apparatus and a controller for such control that the toner amount per unit area of the toner image formed on the image bearing member by the image forming device differs in accordance with a result detected by the detector.

40 Claims, 18 Drawing Sheets

IMAGE FORMING SYSTEM FOR CONTROLLING THE AMOUNT OF TONER DEPOSITED ON A PHOTOSENSITIVE DRUM BASED ON ENVIRONMENTAL CONDITIONS

BACKGROUND OF THE INVENTION

1. Field of the Invention

The present invention relates to an image forming apparatus using an electrophotographic process or an electrostatic recording process and in particular to an image forming apparatus in which an amount of toner formed on an image bearing member is controlled.

2. Related Background Art

FIG. 22 shows a color image forming apparatus of the electrophoto graphic process. The image forming process will be outlined. First, on a photosensitive drum 101, a toner image based on image information is formed. Then, the toner image on the photosensitive drum 101 is transferred to a transfer material adsorbed on a transfer drum 108. This transfer step is repeated by the times needed to form a desired image on the transfer material. Thereafter, the transfer material is separated from the transfer drum 108 and the toner image is fixed on the transfer material by a fixing device 107 and discharged from the apparatus outward.

Besides, as alternative example, FIG. 23 shows a color image forming apparatus.

This image forming apparatus comprises a charging roller 202, an unshown exposure device, a developing device 204 having developing units 204*a*, 204*b*, 204*c* and 204*d*, a cleaner 207*a* of the photosensitive drum 201 and an intermediate transfer drum 205 provided around the photosensitive drum 201, a cleaner 207*b* and a transfer roller 208 provided around the intermediate transfer drum 205 and a fixing unit 209 disposed a little apart from the intermediate transfer drum 205. Connected to the intermediate transfer drum 205 and the transfer roller 208 is a high-voltage power supply 210*a*.

In forming a color image, first a photosensitive drum 201 is rotationally driven at a predetermined peripheral speed in the direction of the arrowhead, the surface of the photosensitive drum 201 is primarily charged by the charging roller 202, a laser beam 203 is scanning exposed by the unshown exposure device and a first color electrostatic latent image is formed on the photosensitive drum 201 and developed by the developing device 204.

The developing device 204 is equipped with a first, a second, a third and a fourth developing units 204*a*, 204*b*, 204*c* and 204*d* connectable and disconnectable from the photosensitive drum 201, in which a yellow toner, a magenta toner, a cyan toner and a black toner, for example, are contained respectively. The first latent image is developed by the first developing unit 204*a* and visualized as yellow toner image.

By applying a voltage of the polarity opposite to the charged polarity of the toner from the high-voltage power supply 210*a* to the intermediate transfer drum 205 in a first transfer position 206*a* where the intermediate transfer drum 205 and the photosensitive drum 201 contact with each other, the obtained yellow toner image is electrostatically transferred to the surface of the intermediate transfer drum 205 (primary transfer). The photosensitive drum 201 after the completion of primary transfer is subjected to the next color image forming after the removal of the toner remaining on the surface with the cleaner 207*a*.

Similarly, after the primary charging of the photosensitive drum 201 by the charging roller 202, exposure with a laser beam 203 is made to form a second color electrostatic latent image and the latent image is developed by the second developing unit 204*b* to form a magenta toner image on the surface of the photosensitive drum 201. This magenta toner image is superposed and transferred over the yellow toner image on the intermediate transfer drum 205.

The above step is also repeated similarly concerning cyan and black color images, while the cyan and black toner images respectively obtained by the development of the third developing unit 204*c* and the fourth developing unit 204*d* are subsequently superposed over and transferred to the surface of the intermediate transfer drum 205. Thereby, a color image with four color toner images of yellow, magenta, cyan and black stacked is formed on the surface of the intermediate transfer drum 205.

Thereafter, the transfer roller 208 disconnected is brought into contact with the surface of the intermediate transfer drum 205 and a voltage of the polarity opposite the charged polarity of the toner is applied from the high-voltage power supply 210*a* to the transfer roller 208, so that at a second transfer position 206*b*, the four color toner image on the intermediate transfer drum 205 is collectively htransferred to the surface of a transfer material P to be conveyed at a predetermined timing to the second transfer position 206*b* where the intermediate transfer drum 205 and the transfer roller 208 contact each other (secondary transfer).

The transfer material P onto which the four color toner image is transferred is conveyed from the intermediate transfer drum 205 to the fixing unit 209, subjected to fixation with a heat roller or the like to make a permanent,image of full color, then discharged from the image forming apparatus outward. The intermediate transfer drum 205 after the completion of the secondary transfer is made ready for the next image forming, a certain amount of toner remaining on the surface is removed by the cleaner 207*b* to be set into action on the intermediate transfer drum 205 at a predetermined timing.

Besides, both of the image forming apparatuses mentioned above are so arranged as capable of forming images on both faces of a transfer material.

Especially in an image forming apparatus as shown in FIG. 22, however, since a transfer of superposing a toner image onto the transfer material is repeated, a so-called counter-transfer may occur in which the toner image transferred already is much apt to be transferred again to the photosensitive drum at the next transfer step.

In the case of forming a blue image, for example, first, a solid magenta image (image of maximum density set in the image forming apparatus) is formed on the transfer material, then a solid cyan image is multiply transferred on the solid magenta image and at a later transfer step, e.g., a transfer step of yellow or black, there takes place a situation that no toner to be transferred is present on the photosensitive drum. Under this situation, when a toner image on the transfer material comes near or contacts the surface of the photosensitive drum, a phenomenon may occur in which part of toner image (here, mainly cyan toner image) on the transfer material is very apt to be counter-transferred onto the photosensitive drum.

In this case, at the portion of cyan toner counter-transferred to the photosensitive drum, the density of the cyan toner image lowers and the color of magenta forming the image under the layer of the cyan toner image appears, thus resulting in a significant deterioration of image quality.

Furthermore, this phenomenon is also a factor for making the stability of a multiple transfer difficult because of being dependent on a change in the toner charge amount or in the resistance value of a transfer material accompanying a change in temperature and humidity.

Besides, in recent years, since the particle diameter of toner has become smaller with a higher image quality, the toner charge amount per particle decreases but the total amount of charges tends to increase. Thus, the amount of transfer electric current or the transfer voltage required for the transfer of a solid image has increased. This rise in transfer electric current or transfer voltage is found to also adversely affect the above phenomenon of counter-transfer.

Besides, if the water content of a transfer material is small on occasions, an image fault (poor transfer) like marks of an abnormal discharge occurs during the progress of transfer.

Besides, in an image forming apparatus using an intermediate transfer member as shown in FIG. 23, a great amount of toner for four colors stacked on the intermediate transfer drum 205 ought to be transferred to the transfer material P at one stretch in the secondary transfer step as mentioned above. At this time, if the absolute charge amount of transferred toner is relatively small, the secondary transfer proceeds well.

As significantly noticeable in some used atmospheres of an image forming apparatus, especially under environments of low temperatures and low humidity, however, there was a problem that an image fault like marks of an abnormal discharge is very apt to occur when an attempt is made to transfer a full amount of toner from the intermediate transfer drum 205 to the transfer material P under a very large situation of absolute value of toner charge amount.

Since the toner charge amount for at least one color among the four colors of toner used in image forming is smaller than those of the other colors, after the toner for four colors is stacked on the intermediate transfer drum 205 to make the degree of transfer of the toner for four colors even, the toner on the intermediate transfer drum 205 is often subjected to recharging by means such as corona charging unit to equate the toner charge amounts for four colors, thus making the degree of each transfer even, but there were cases where the absolute value of toner charge amount became greater than before in this manner, thereby resulting in occurrence of an image fault like marks,of an abnormal discharge during the progress of the secondary transfer as with the above.

Besides, in both of the image forming apparatuses mentioned above image forming was made on the second face subsequent to image forming on the first face of a transfer material and at that time there were cases where a point-shaped loss of transfer occurred on the image transferred onto the second face, thus leading to the deterioration of image quality.

SUMMARY OF THE INVENTION

It is an object of the present invention to provide an image forming apparatus capable of preventing the image quality from deteriorating due to the occurrence of poor transferring at the transfer of an image to a transfer material.

The other objects of the present invention would be clarified by reading the following detailed description.

DETAILED DESCRIPTION OF THE PREFERRED EMBODIMENTS

Figure 1:
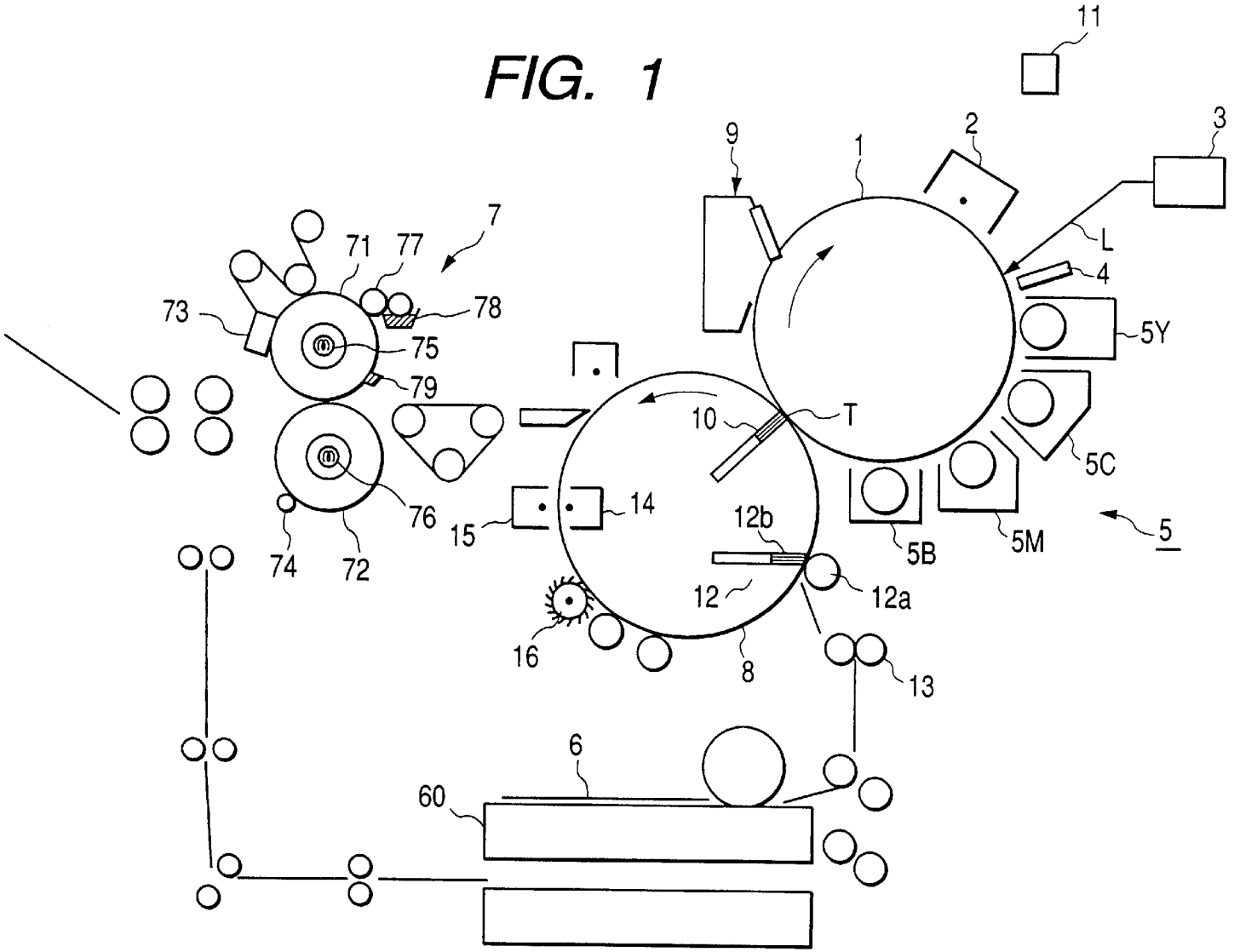
FIG. 1 is a schematic structural view showing one embodiment of representative image forming apparatus according to the present invention.

Hereinafter, the embodiments of the present invention will be described referring to the drawings.

Embodiment 1

In FIG. 1, one example of a color image forming apparatus according to the electrophotographic process. In a color image forming apparatus of this embodiment, a photosensitive drum 1 as image bearing member is rotatively pivoted so as to rotate in the direction of the arrowhead, around which a primary charger 2, an exposure device 3, an electrostatic voltmeter 4 for detecting the surface electric potential of the photosensitive drum 1, a developing device 5, a transfer device 8 and a cleaning device 9 are disposed.

The primary charger 2 uniformly charges the photosensitive drum 1 (in this embodiment, negatively), whereas the exposure device 3 scans rays corresponding to image signals of individual color components generated from a light source device by rotating a polygon mirror, deflectes the luminous flux of its scanning rays by a reflection mirror so that the luminous flux is: converged on the generating line of the photosensitive drum 1 via a fθ lens to successively form latent images on the photosensitive drum 1 for the respective colors corresponding to image signals.

In this embodiment, the developing device 5 installed sideways to the photosensitive drum 1 comprises a magenta developing unit 5M, a cyan developing unit 5C, a yellow developing unit 5Y and a black developing unit 5B. In these magenta, cyan, yellow and black developing units 5M, 5C, 5Y and 5B, developers for magenta, cyan, yellow and black colors (in Embodiment 1, negatively charged toner) are respectively filled at a predetermined amount. Individual developing units 5 (5M, 5C, 5Y and 5B) are operated to come into contact with and be in out of contact with the photosensitive drum 1 at positions opposite the outer peripheral surface of the photosensitive drum 1 to perform development of electrostatic latent images formed on the photosensitive drum 1.

Obliquely downward the photosensitive drum 1, a transfer drum as transfer device 8 for bearing and conveying a transfer material is provided. To this transfer drum 8, a transfer material 6 is supplied from a transfer material cassette 60 provided at the bottom of the main body;of the apparatus via registering rollers 13 and so on.

The transfer drum 8 is a drum-shaped member formed after joining a dielectric material sheet made of polyethylene terephthalate, vinylidene polyfluoride, polycarbonate or polyurethane resin film on the surface of a frame linked by a linking member of two rings.

Taking a case of four color image forming as an example, the operation of this color image forming apparatus as a whole will be described in brief.

The photosensitive drum 1 rotates to charge its surface uniformly by the primary charger 2. Next, a laser beam L modulated in response to a first color, e.g. magenta image signal of a draft is irradiated to the photosensitive drum 1 by the exposure device 3 to form a magenta electrostatic latent image on the photosensitive drum 1. This latent image is developed by the magenta developing unit 5M established in advance at a developing position to form a first color magenta toner image on the photosensitive drum 1.

On the other hand, from the cassette 60, a transfer material 6 is pushed out in the direction along the transfer drum 8 by the registering rollers 13 or the like. Simultaneously with the push of this transfer material 6, an adsorbing roller 12*a* of the adsorbing and charging means 12 comprising the adsorbing roller, 12*a* and an adsorbing charger 12*b* is pushed onto the surface of the transfer drum 8 and adsorbed and charged from the back face side by the adsorbing charger 12*b* to bear the transfer material 6 on the transfer drum 8 electrostatically.

The transfer drum 8 rotates in the direction of the arrowhead synchronously with the photosensitive drum 1 and the magenta toner image formed on the photosensitive drum 1 is transferred to the transfer material 6 on the transfer drum 8 under action of the transfer charger 10 located at the transfer position T (with a predetermined positive voltage applied to the transfer charger 10). The transfer drum 8 continues rotating as it is and makes ready for the transfer of the next color, cyan toner image.

When transfer of a magenta toner image is completed, the residual toner remaining on the photosensitive drum 1 after the transfer is cleaned by the cleaning member 9, then charging with the primary charger 2, irradiation of a laser beam L and suchlike are similarly performed to form a second color cyan toner image on the photosensitive drum 1 and the cyan toner image is superposed over the magenta toner image and transferred onto the transfer material 6. Similar image forming steps are carried out also concerning a third color yellow and black and the four color magenta, cyan, yellow and black toner images are transferred onto the transfer material 6 in superposed relation to obtain a color image.

The transfer material 6 with four color toner images transferred thereto is peeled off from the transfer drum 8 by action of a separating pawl and sent to the fixing device 7 by a conveyer belt or the like.

The fixing device 7 comprises a fixing roller 71 and a pressurizing roller 72. In the fixing and pressurizing rollers 71 and 72, heating heaters 75 and 76 are respectively incorporated, while heat-resistant cleaning members 73 and 74 and a fixing temperature control thermistor 79 are disposed adjacently to the fixing and pressurizing rollers 71 and 72. Furthermore, an application roller 77 for applying a molding lubricant oil such as dimethyl silicone oil to the fixing roller 71 and an oil basin 78 for supplying the molding lubricant oil are provided.

By heating and pressurizing the conveyed transfer material 6 by the fixing roller 71 and the pressurizing roller 72, the fixing device 7 performs a color mixing of individual color toner images and a fixation to the transfer material 6 to form a full-color print image. Thereafter, the transfer material 6 is discharged from the apparatus outward.

After discharged by residual charge eliminator 14 and 15 to remove the electrostatic adsorbing power, the toner remaining on the transfer drum 8 is scraped off by use of a rotating fur brush 16. As other means for removing the residual toner, a blade or a non-woven cloth is singly or jointly used.

As a result of making many investigations and experiments for the purpose of solving the above problems of counter-transfer and poor transfer, the present inventors could elucidate the occurrence mechanism of counter-transfer and it was confirmed that there is the upper limit for the retainable charge amount of a transfer material dependent on the environment and the type of the transfer material.

First, while supplying charges to a transfer material, the inventors measured the surface electric potential of the transfer material relative to the supplied charge amount. The resultant relations between the supplied charge amount to individual transfer materials and the surface electric potential of individual transfer materials are shown in FIG. 2.

Figure 2:
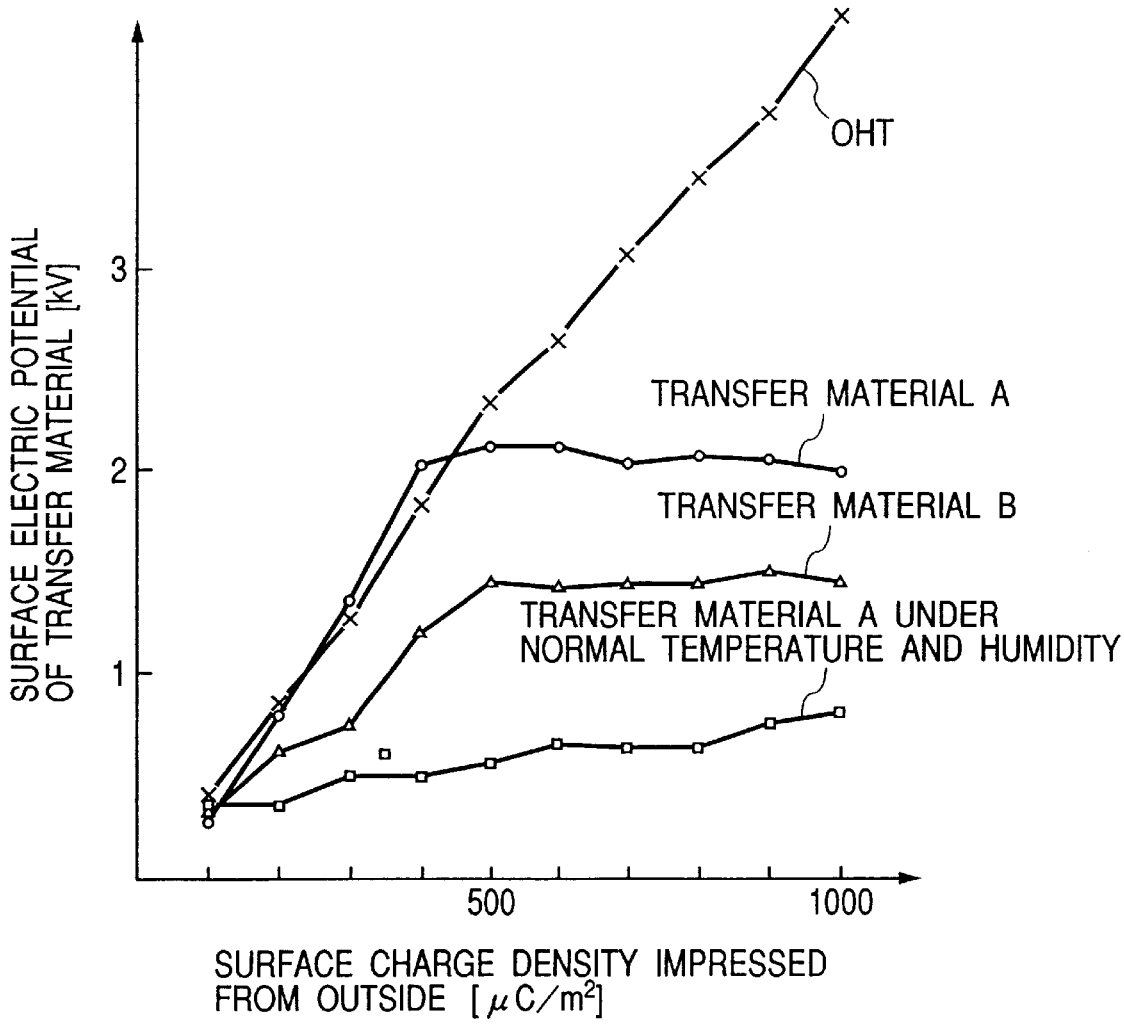
FIG. 2 is a graph showing the relationship between the charge amount per unit area supplied to a transfer material and the surface electric potential of the transfer material at that time.

It has been revealed from FIG. 2 that the surface electric potential rises in proportion to the supplied charge amount in the case of using an OHT (overhead projector transparent resin sheet) as transfer material whereas the surface electric charge stops to rise beyond a certain supplied charge amount for the transfer materials A and B. In Embodiment 1, the transfer material A is NP1 fine paper available from Haga Foreign Paper Shop (basis weight: 128 g/m$^2$; Thickness: 120 $\mu$m) and the transfer material B is Canon CLC double-faced thick foreign paper (basis weight: 105 g/m$^2$; Thickness: 100 $\mu$m).

Besides, for the transfer material A under normal temperature and normal humidity (here, temperature of 23° C. and humidity of 60%), the surface electric potential rises in proportion to the supplied charge amount and is not saturated within the measured range. However, FIG. 2 indicates that, when evaluated for an absolute water content of 0.5 g/m$^3$ at a temperature of 23° C. and a humidity of 5%, the retainable charge amounts in the transfer materials A and B are 500 $\mu$C/m$^2$ and 450 $\mu$C/m$^2$, respectively and the above transfer materials become unable to retain the charge even if greater amounts of charge are supplied than the respective evaluated values. In other words, the retainable charge amount per unit area in a transfer material is found to depend on the environments and the type of the transfer material.

Figure 3:
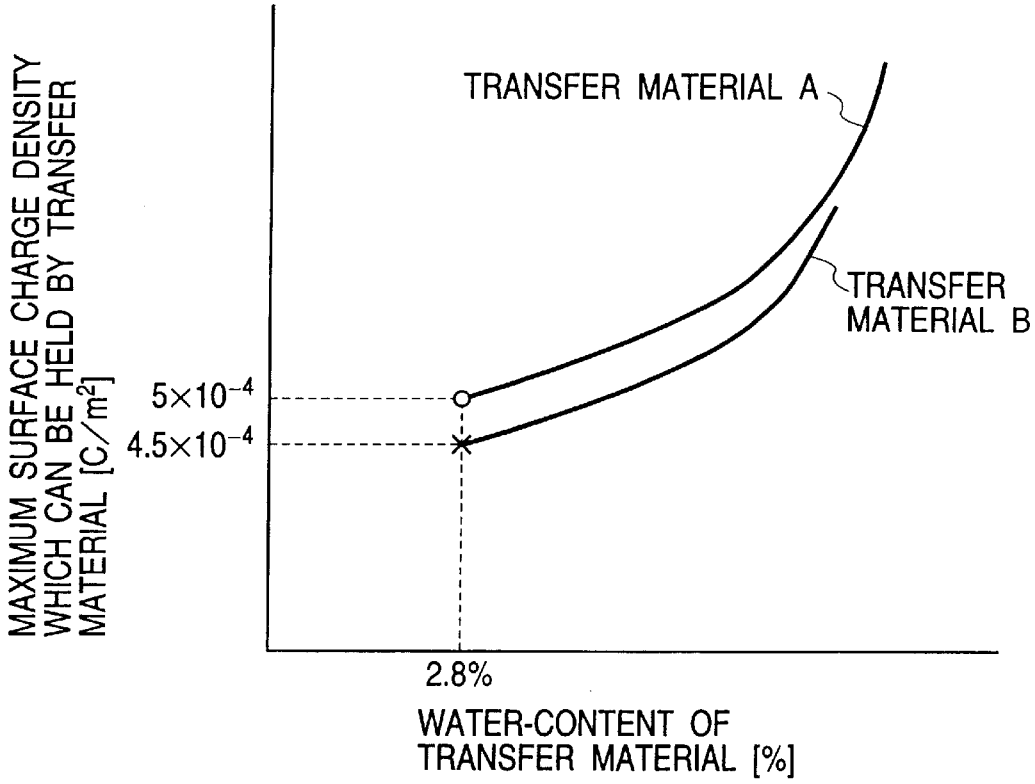
FIG. 3 is a graph showing the relationship between the water content of a transfer material and the maximum retainable surface charge density of the transfer material.

For the transfer materials A and B, FIG. 3 shows the relations between their water contents and their maximum retainable charge amounts per unit area.

Adapting the above examined results to the case of Embodiment 1 makes it possible to analyze the former problems.

When the image forming apparatus of Embodiment 1 shown in FIG. 1 is used to form images, a measured value of total charge amount in toner developed on the photosensitive drum 1 is 30$\mu$C/g under low humidity as mentioned above and the toner bearing amount on the photosensitive drum 1 per unit area of solid image is 10 g/m$^2$ for monocular. Thus, the total toner charge amount per unit area becomes 300 $\mu$C/m$^2$. In fact, not only by the transfer of monochrome image but also by the multiple transfer of four color toner images, a full color image,is often formed, but in that case, the maximum toner bearing amount per unit area formed on the transfer material 6 becomes still greater. Herein, the toner bearing amount on the transfer material 6 is often determined, for example, by the fixing condition or the like.

The image forming apparatus of this embodiment is so arranged as to form a monochrome image at a maximum fixable bearing amount per unit area of 10 g/m$^2$ under a fixing temperature of 150° C. and as to form a full color image up to about double the maximum bearing amount of a monochrome image.

Accordingly,: with this embodiment, since the maximum toner bearing amount per unit area is set to 20 g/m$^2$ by employing the masking treatment for the secondary color, the tertiary color, etc. in the image treatment, the maximum toner charge amount per unit area becomes 600 $\mu$C/m$^2$.

It follows from these that with the transfer material A, for example, the charge amount corresponding to the maximum toner bearing amount on the transfer material is greater by 100 $\mu$C/m$^2$ than the maximum retainable charge amount per unit area in the transfer material of 500 $\mu$C/m$^2$ according to the former setting and therefore the transfer material itself becomes unable to retain its charge as mentioned above. Namely, the toner transferred once from the photosensitive drum to the transfer material is partly transferred from; on the transfer material to the photosensitive drum at the transfer nip during the next color image transfer, thereby resulting in occurrence of counter-transfer or poor transfer.

Then, in this embodiment, the retainable charge amount per unit area in a transfer material depending on the environment and the type of the transfer material is set in advance and an arrangement is employed in which the maximum toner bearing amount per unit area for each color image formed on the photosensitive drum 1 is controlled by the CPU in such a variable manner as to prevent the charge amount corresponding to the maximum toner bearing amount per unit area on the transfer material from exceeding the preset charge amount. Using a general formula, a description will be made as follows:

That is, letting Qt (k) (C/kg), M (kg/m$^2$) and Qp (s, k) be the charge amount per unit area of the toner to be developed on a photosensitive drum, the toner bearing amount per unit area and the retainable charge amount per unit area for a transfer material, a value of M is so arranged as to be set which satisfies $Qp(s, k)/Qt(k) \geqq M$, where k and s in the parentheses ( ) denote an environmental factor and the type of a transfer material, respectively, and the environmental factor comprises a temperature, a humidity, an absolute water content, etc.

The image forming process in this embodiment will be described.

First, setting an environment and the type of a transfer material are performed. With respect to an environment, automatic detecting means based on a temperature/humidity sensor 11 is available or a copy user may input data for himself. Besides, also with respect to the type of a transfer material, automatic detecting means is available or a copy user may input data for himself similarly. And, joint use of the above two means is also allowable.

Once the environment and the type of a transfer material are determined, values of Qt and Qp evaluated in advance from the measured results are recorded and set in a storage medium, then Qt and Qp for the setup environment and transfer material type are determined from this table of setup values, so that the maximum toner bearing amount per unit area is determined according to the above formula. If the maximum toner bearing amount per unit area M1 determined here is smaller than the initial setup value M0, the toner bearing value is lowered to M1. Or, if greater than M0 and equal to or smaller than the upper limit of 20 g/m$^2$ of the maximum toner bearing amount per unit area, the toner bearing value is made near to the selected value M1 without limit from the setup value. However, if the maximum toner bearing amount per unit area M1 exceeds 20 g/m$^2$, M is set to 20 g/m$^2$. Besides, the lower limit is set to 60% of the standard setup value for the maximum toner bearing amount, i.e. 12 g/m$^2$. The maximum toner bearing amount per unit area according to the above formula, if lower than this value, is set to 12 g/m$^2$ from the viewpoint of securing the density. However, it is not always necessary to setup the lower limit, or the lower limit can be set up separately.

Figure 4:
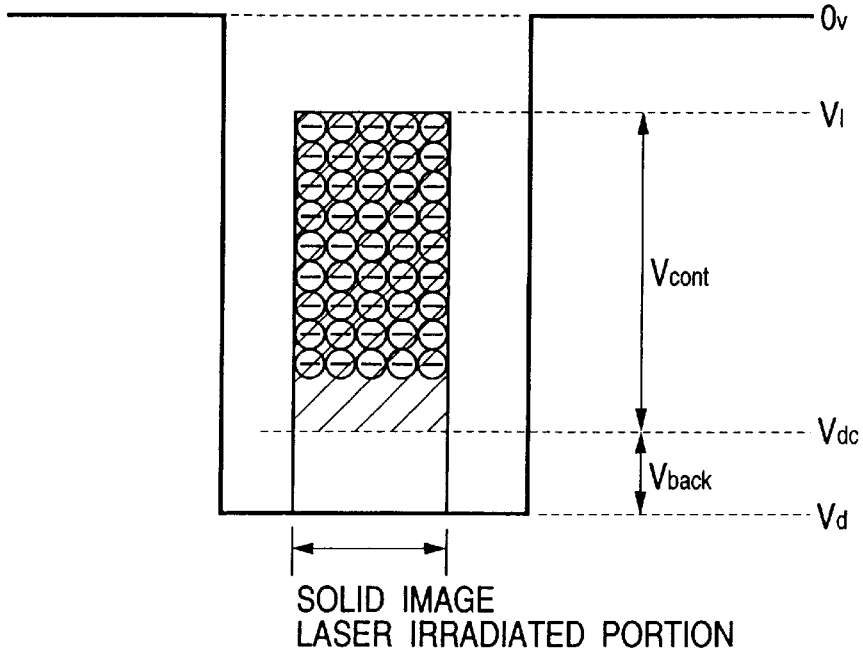
FIG. 4 is an illustration of the electric potential of a photosensitive drum.

As means for making the above toner bearing amount various, means for making Vcont variable was used in this embodiment. Next, referring to FIGS. 1 and 4, a brief description will be made of Vcont, Vback and so on in this embodiment.

According to this embodiment, as mentioned above, the photosensitive drum 1 is uniformly charged all over the peripheral surface by a primary charger 2. This electric potential is set to Vd. On irradiating a laser beam L on the photosensitive drum at this electric potential, the electric potential of this irradiated portion rises.

Let Vl be the electric potential on a photosensitive drum 1 which to form a monochrome solid image on. In contrast, letting Vdc be the developing bias, important factors are defined in such representations as Vcont=Vl−Vdc and Vback=Vdc−Vd. Toner is developed on the photosensitive drum 1 so as to fill up the potential difference between Vl and Vdc. Thus, by changing a value of Vcont, the (maximum) toner bearing amount per unit area can be varied.

Besides, the toner bearing amount becomes detectable by installing a sensor for detecting the density of toner developed on the photosensitive drum. This density detecting means serves to develop a monochrome solid image on a photosensitive drum except the image region, irradiate a light beam from over its image onto the photosensitive drum and detect the reflected light, but other means are allowable. The relation between the reflected light amount and either the density or the bearing amount is set up in advance and, on estimating the toner bearing amount readily from the detection of reflected light, a value of Vcont is so arranged as to become adjustable. Although the relation between the maximum toner bearing amount on a photosensitive drum and Vcont is set up in advance, a value of Vcont is so arranged as to be adjusted automatically and to become equal to the target toner bearing amount, if the toner bearing amount should deviate greatly from the target value as a result of the above measurement.

By carrying out the above process, an executable condition of a good image forming is implemented.

Specifically, referring to part of this embodiment, the above content will be stated. On selecting the transfer material A under low humidity (temperature of 23° C. and humidity of 5%), the table of setup values suggests $Qt=30\times10^{-3}$ C/kg and $Qp=500\times10^{-6}$ C/m$^2$ and accordingly M=16.7 g/m$^2$ is obtained (1.67 mg/cm$^2$), thus leading to a 16.5% reduction of toner bearing amount from the standard setup value. In this case, the toner bearing amount for the monochrome solid image is 8.3 g/m$^2$ and accordingly it is advisable to modify the required Vcont from a former setup value of 430V to 400V, and at the same time Vback to 130V, Vl to −120V, Vd to −680V and Vdc to −550V.

Besides, in the case of forming a blue image, for example, monochrome solid images are multiply transferred in the sequence of magenta and cyan with this embodiment because the color sequence of image forming according to this embodiment comprises magenta, cyan, yellow and black. Thus, as the toner bearing amounts of the respective colors, the maximum toner bearing amount on a transfer material M have only to be equally divided in halves. That is, it is only necessary to set the toner bearing amount of magenta to be developed first and that of cyan to be developed secondly to 8.3 g/m$^2$ and 8.3 g/m$^2$, respectively.

In the above description, the maximum toner bearing amounts per unit area of magenta and cyan was allotted at a ratio of ½, but the toner bearing amount of cyan may be so arranged as to be greater than the toner bearing amount of magenta in case of a blue image considering a greater tendency of counter-transfer for the toner layer formed at the upper layer on a transfer material.

Furthermore, in the above representative examples, a case of reducing the toner bearing amount to as great extent as 13.5% was described, but if this extent of reduction is slight, e.g. on the order of 2 to 4%, an arrangement may be taken in which only the toner bearing amount of magenta forming a toner image at the lowermost layer is reduced.

Like this, lowering the maximum toner bearing amounts per unit area of individual colors enabled the reduction of counter-transfer in which the tone image transferred once from a photosensitive drum to a transfer material is transferred with a transfer nip from on the transfer material to the photosensitive drum during the progress of multiple transfer, thus making a stable multiple transfer implementable.

Embodiment 2

This embodiment can be basically regarded as equivalent to Embodiment 1, but is an arrangement that corresponding to a change in maximum toner bearing amount per unit area, if any, a value of electric current flowing through a transfer charger 10 (constant-current control value) is varied during the progress of transfer.

Figure 5:
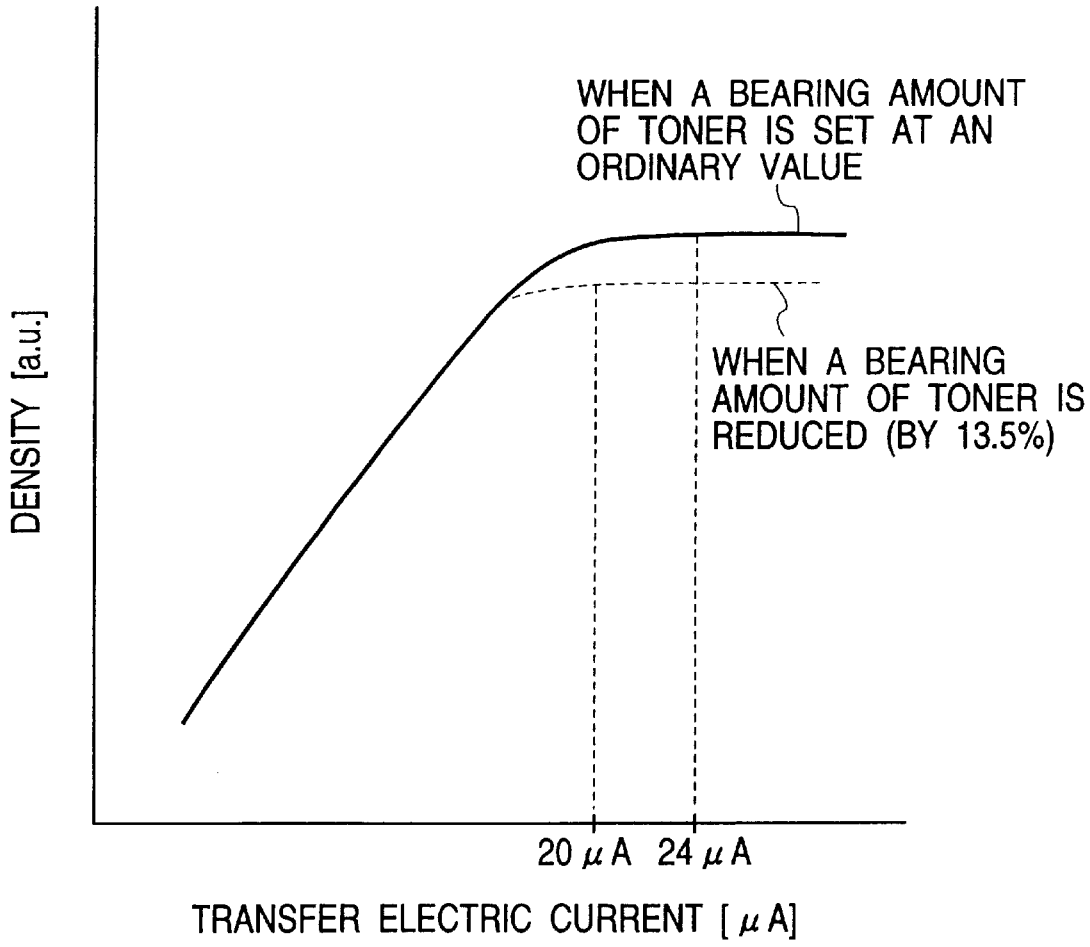
FIG. 5 is a graph showing the relationship between the transfer electric current and the density of an output image for monochromatic solid image.

According to this embodiment, for a reduced toner bearing amount, a value of transfer electric current needed for the transfer of the toner is also lowered as shown in FIG. 5. Charge supplied more than needed causes an abnormal discharge in and near the transfer nip, thus resulting in the occurrence of image faults. Thus, it is preferable to make a transfer with the necessary minimum of supplied charge.

In case of a toner charge amount of 30 $\mu$C/g and a maximum toner bearing amount per unit area of 20 g/m$^2$ under low humidity (temperature of 23° C. and humidity of 5%) environment, a transfer current of 24 $\mu$A was required, but when the toner bearing amount is reduced by 13.5% as with Embodiment 1, a transfer electric current of about 20 $\mu$A suffices for transfer.

Furthermore, as described in Embodiment 1, it is much preferable to modify values of transfer electric current for the respective colors correspondingly if the maximum toner bearing amount per unit area is changed for individual colors.

In this embodiment, use of a table, e.g. ROM as storage medium, for storing the maximum retainable charge amount per unit area of a transfer material for individual environments, the toner charge amount for individual environments and so on enables a value of required transfer electric current to be set by the CPU.

With such an arrangement, an effect similar to that of Embodiment 1 is obtained in this embodiment and image faults originating in abnormal discharge caused by excessive supply charge to a transfer material are to be prevented.

Embodiment 3

This embodiment can be basically regarded as equivalent to Embodiment 1, but is characterized in automatically monitoring (detecting) the condition of a transfer material and making the maximum toner bearing amount per unit area variable correspondingly.

To be specific, with this embodiment, electric current flowing through a transfer charger 10 undergoes a constant-current control during the progress of transfer and transfer voltage in the constant-current control is monitored during the progress of image forming (this voltage is designated with Vi, where i denote the sequence of colors). Here, transfer voltage vs transfer electric current in absence of a transfer material under individual environments is measured and stored in a storage medium (ROM) (this voltage is designated with Voi and is depicted with dotted lines in FIGS. 6 and 7).

A differentials between the transfer voltage monitored during the progress of image forming and the transfer voltage stored in the storage medium ($\Delta Vi=Vi-Voi$) is monitored. For a certain transfer electric current, $\Delta Vi$ is normally constant, but when the supply charge amount to a transfer material exceeds the retainable charge amount of the transfer material, this $\Delta Vi$ decreases at the transfer of a certain color toner image. For example, there is a phenomenon in which ΔVi is constant from the first color to the third color but becomes almost 0 for the final color. Thus, in this embodiment, the transfer electric current is set so as to keep ΔVi always constant and the toner bearing amount is set to a value transferable at this transfer electric current.

Figure 6:
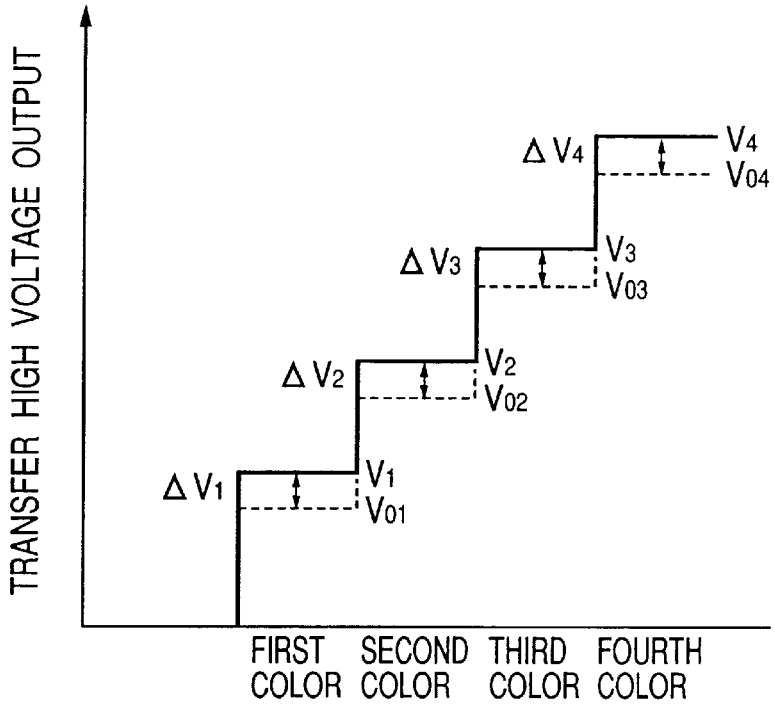
FIG. 6 is a normal rising chart of transfer electric potential for individual colors.
Figure 7:
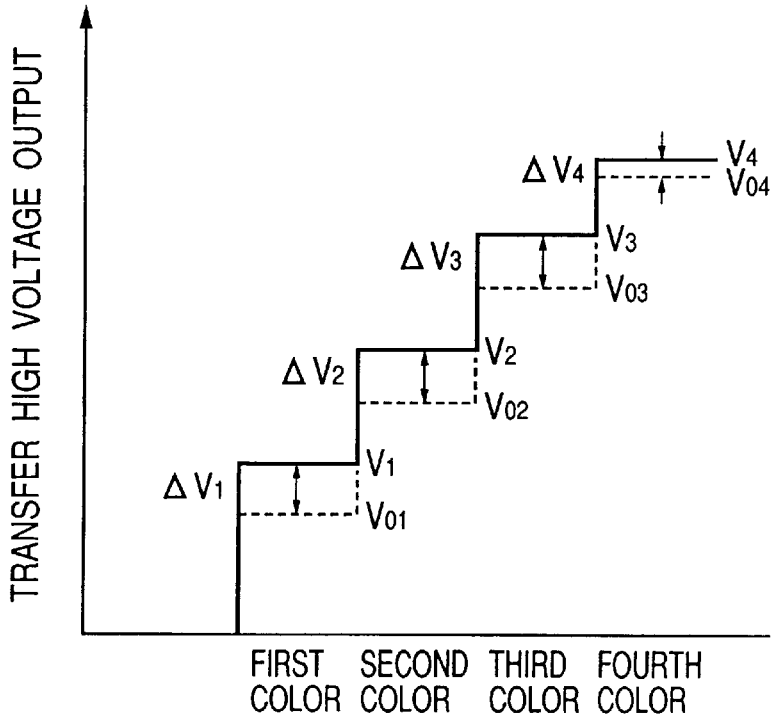
FIG. 7 is a rising chart of transfer electric potential in case of exceeding the retainable surface charge density.

FIG. 6 shows the transfer electric potential after the countermeasure taken and FIG. 7 shows the transfer electric potential in case of charge supply beyond the retainable charge amount per unit area of a transfer material.

When a transfer is made at a standard setup transfer electric current value of 24 μA in passing transfer material A under low humidity (temperature of 23° C. and humidity of 5%), the electric potential for the first sheet was monitored. As a result, values of ΔV1 to ΔV3 lay within a range of 540V to 570V, but a value of ΔV4 alone was 180V. In this embodiment, the following countermeasure was set so as to be taken if a deviation of 20% from ΔV1 takes place, but this error region may be defined at other values.

Since ΔV4 caused a deviation of greater than 20% from ΔV1 as mentioned above, a countermeasure was taken according to the following calculations. Here, in view of ΣΔVi=1890V, the transfer electric current I1 is set so that ΔV1=ΣΔVi/4≅470V. Since this can be easily computed from $$I1 \cong (\Sigma \Delta Vi/4)/\Delta V1 \times Io$$

(here, Io: initial setup electric current value and ΔV1: differential voltage for the first color), the initial setting value of 24 μA is set to 20 μA in the above representative example and the maximum toner bearing amount per unit area is also determined correspondingly so that $$M1 \cong (\Sigma \Delta Vi/4)/V1 \times M0$$

(here, M0: initial maximum toner bearing amount per unit area).

In this manner, the toner bearing amount formed on a photosensitive drum 1 and the transfer electric current are automatically made variable without input of the type of a transfer material.

Incidentally, the above means is only one mean for automatically detecting the impedance of a transfer material to the utmost and may be other means. For example, the transfer high-voltage output may be subjected to constant-voltage control to monitor the electric current of that time (in this case, the setup value stored beforehand in a storage medium is also an electric current value) or the water content of a transfer material may be sensed by using an infrared water content meter to automatically detect the impedance of a transfer material in accordance with the relation between the absolute water content of the transfer material and the impedance.

In all the above embodiments, image forming apparatuses for forming images by a single photosensitive drum 1 and a single transfer drum 8 as shown in FIG. 1 were described, but needless to say the present invention is applicable to a tandem type image forming apparatus (unshown) using four photosensitive drums as often observed in recent years.

Besides, the present invention is not limited to color image forming apparatuses described in each of the above embodiments, but is applied to a monochrome image forming apparatus, in which similar operating effects can be attained.

Embodiment 4

Figure 8:
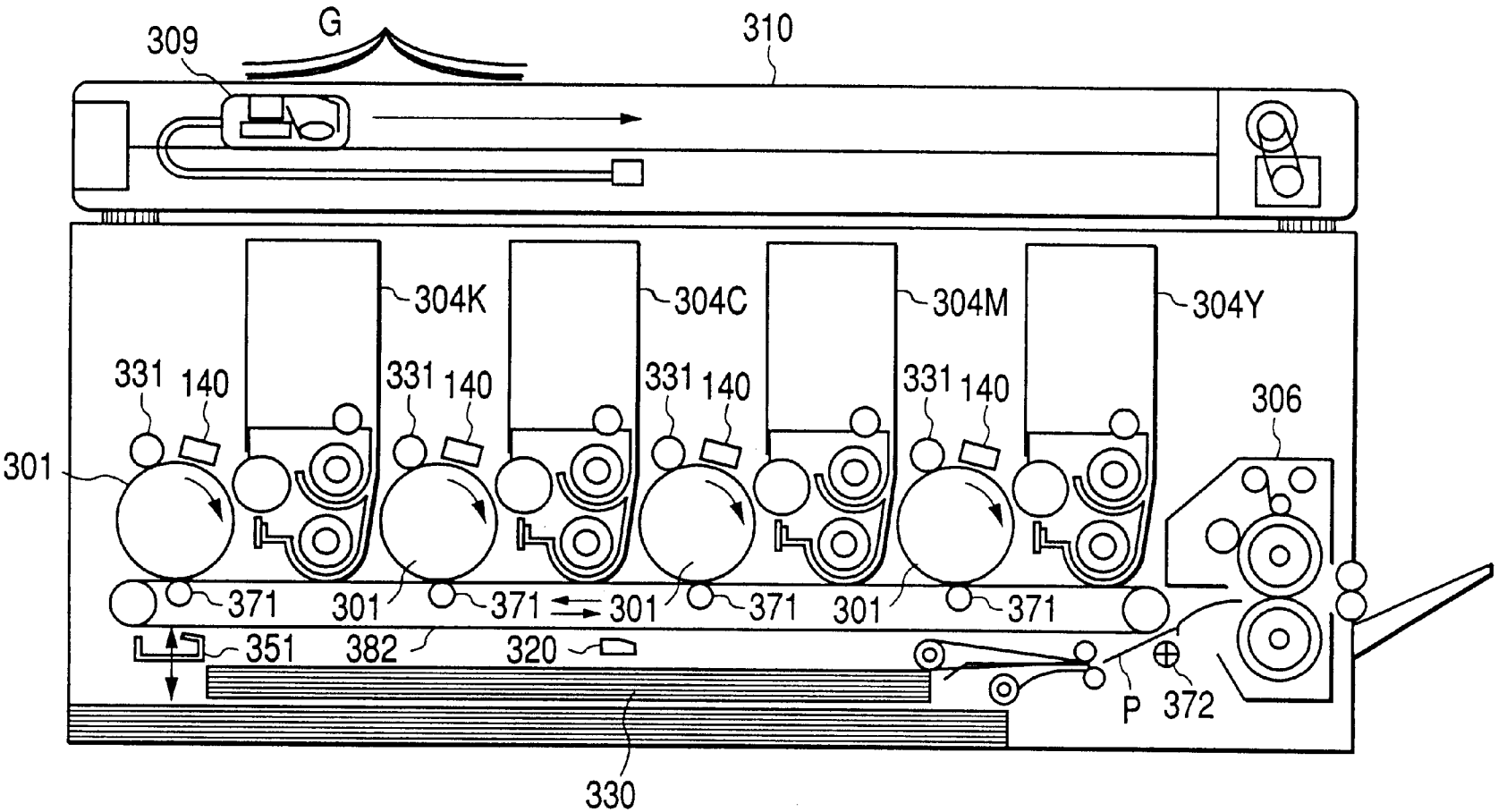
FIG. 8 is a schematic structural view showing one embodiment of an image forming apparatus according to the present invention.

FIG. 8 is a schematic structural view showing one embodiment of an image forming apparatus according to the present invention. This apparatus is a color image forming apparatus with using the electrophotographic process comprising four image forming units for yellow, magenta, cyan and black which outputs a full-color image.

This image forming apparatus uses the two-component developing method as developing method and employs a developer comprising a mixture of toner produced by the polymerizing method with magnetic carrier as the two-component developer. Besides, a developing device in each image forming unit jointly serves for a cleaner, in which the cleaner for a photosensitive drum is omitted.

After the multiple transfer onto an intermediate transfer belt 382 as intermediate transfer member by first transfer means 371, a toner image formed by each image forming unit is collectively transferred to a transfer material by second transfer means 372 to form a full-color image.

Hereinafter, a detailed description will be described of this embodiment. First, an original G is set on an original stand 310 with the surface to be copied kept on the underside. Next, by depressing a copy button, copy starts. Read of an image of the original is made by a scanner unit 309 and the color image information read about red, green and blue is chromatically decomposed into yellow, magenta, cyan and black to convert the resultant color components into signals and send them to a printer section.

In the printer section, the respective image forming units for yellow, magenta, cyan and black are provided. Each image forming unit comprises a photosensitive drum 301, a charging roller 331 for uniformly charging the photosensitive drum 301, an LED solid scanner 140 as image exposure system for forming an electrostatic latent image on the charged photosensitive drum 301, a developing units 304Y, 304M, 304C and 304K for developing the formed latent images with toner and transfer rollers 371 for electrostatically transferring the obtained toner images to an intermediate transfer belt 382.

When a yellow image signal is sent to the printer section, in a yellow image forming unit, an electrostatic latent image is formed by irradiating a light signal corresponding to the yellow image signal on the photosensitive drum 301 charged in advance by the charging means 331 by use of the scanner 140. This electrostatic latent image is developed by the developing unit 304Y with yellow toner contained to form a yellow toner image on the photosensitive drum 301. This yellow toner image is transferred onto the intermediate transfer belt 382 by the relevant transfer roller 371.

Simultaneously with this operation, in a magenta image unit, the light signal corresponding to a magenta image signal is irradiated onto the photosensitive drum 301 to form an electrostatic latent image on the photosensitive drum 301 and this electrostatic latent image is developed by the developing unit 304M with magenta toner contained to form a magenta toner image on the photosensitive drum 301. The magenta toner image formed thus is transferred to the intermediate transfer belt 382 with the yellow toner image already formed so as to be superposed thereon. Furthermore, by performing similar steps also concerning cyan and black, a full-color image is formed on the intermediate transfer belt 382.

The full-color image obtained by the above steps on the intermediate transfer belt 382 is transferred to a transfer material P conveyed from the transfer material store cassette 330 by the transfer roller 372 with a voltage applied as second transfer means. During the progress of transfer, electric current flowing through the transfer roller 372 undergoes a constant-current control. The transfer material P is conveyed to the fixing device 306 and thermally fixed. At this time, the toner remaining on the intermediate transfer belt 382 is cleaned by the ON/OFF capable (retractable from and movable into contact with the intermediate transfer belt 382) cleaning device 351.

Meanwhile, as mentioned above, under circumstances such as low temperature and low humidity environment in which the toner charge amount becomes very large, an abnormal discharge is generated and image faults are likely to occur in the transfer of toner images stacked on the intermediate transfer member to a transfer material.

According to a study by the present inventors, this abnormal discharge was revealed to be generated by the following mechanism.

Figure 9:
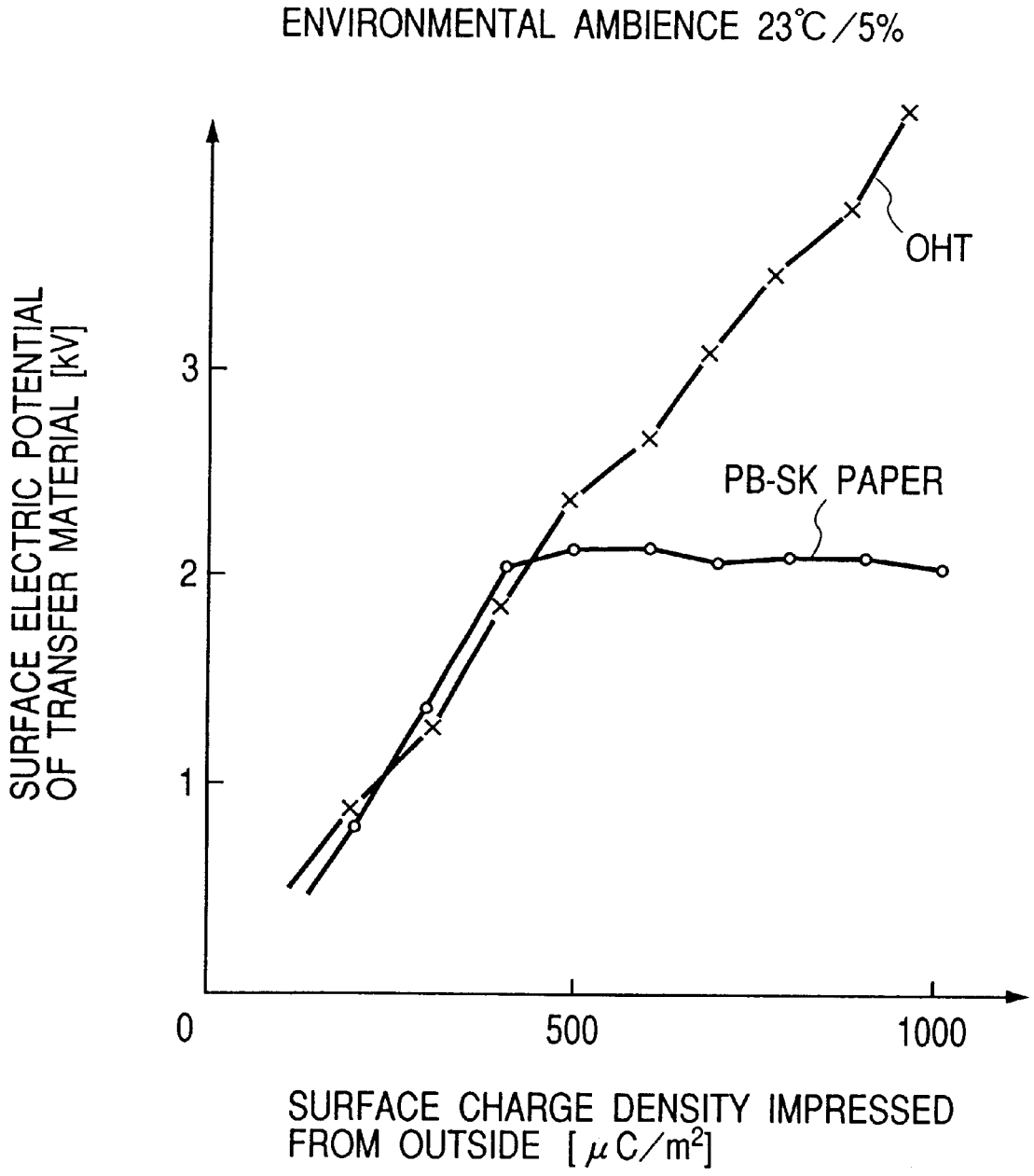
FIG. 9 is a graph showing relations between surface charge density given to a transfer material and surface electric potential thereof under environments of low temperature and low humidity.

First, FIG. 9 shows relations between the surface charge density impressed from outside onto the surface of transfer materials fully accommodated to a normal temperature and low humidity environmental ambience of 23° C./5% and the surface electric potential of the transfer materials.

As understood from reference of FIG. 9, the surface electric potential of a transfer material evidently is saturated without reaching a certain fixed value under normal temperature and low humidity environment, i.e. a very small absolute water content in air. By the way, the absolute water content under 23° C./5% is 0.5 g/1 kg air.

The saturation value of surface electric potential in this transfer material fully accommodated to a normal temperature and low humidity environmental ambience of 23° C./5% depends on the type of a transfer material and was about 2 kV for PB-SK paper manufactured by Nippon Paper Industries Co., Ltd. (basis weight: 64 g/m$^2$). In the representation of the form of retainable charge amount, this amounted to about 500 $\mu$C/m$^2$. This situation shows much the same tendency independent of plus polarity or minus polarity. Incidentally, even under such a normal temperature and low humidity environment, a transfer material less subject to environmental ambience such as OHT film never exhibits a saturation of its surface electric potential, i.e. its retainable charge amount unlike the above paper.

Figure 10:
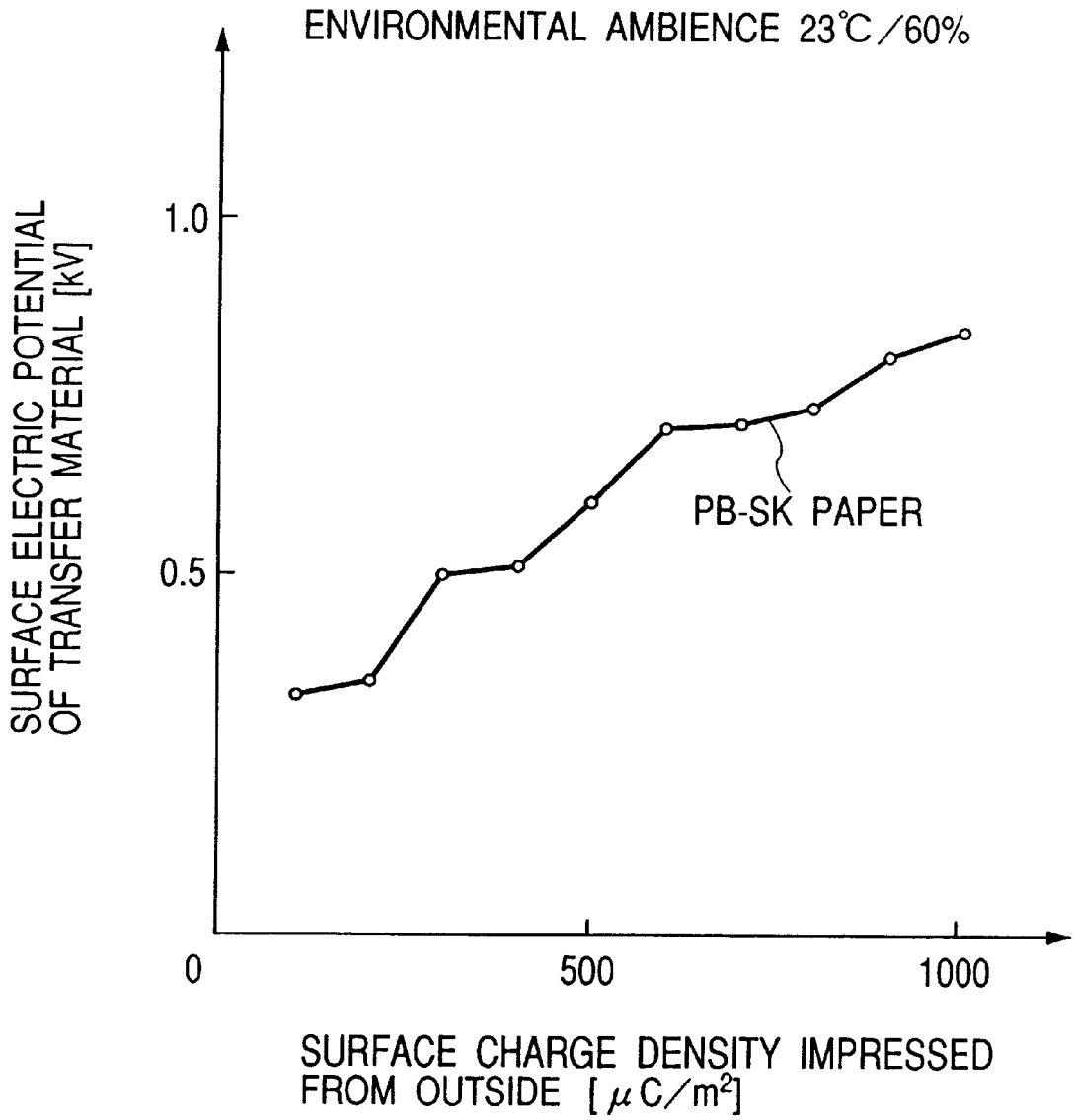
FIG. 10 is a graph showing a relation between surface charge density given to a transfer material and surface electric potential thereof under environments of normal temperature and normal humidity.

Next, FIG. 10 shows a relation between the surface charge density externally given onto the surface of a transfer material fully accommodated to a normal temperature and normal humidity environmental ambience of 23° C./60% and the surface electric potential thereof.

As understood from reference of FIG. 10, the surface electric potential of a transfer material evidently is proportional to the surface charge density externally given onto the surface of the transfer material up to the order of a secondary transfer voltage used for the image forming of ordinary electrophotographic process like the present invention, specifically up to the order of about 10 kV under normal temperature and normal humidity environment, i.e. in moderate presence of absolute water content in air. By the way, the absolute water content under 23° C./60% is 10.0 g/1 kg air.

Figure 11:
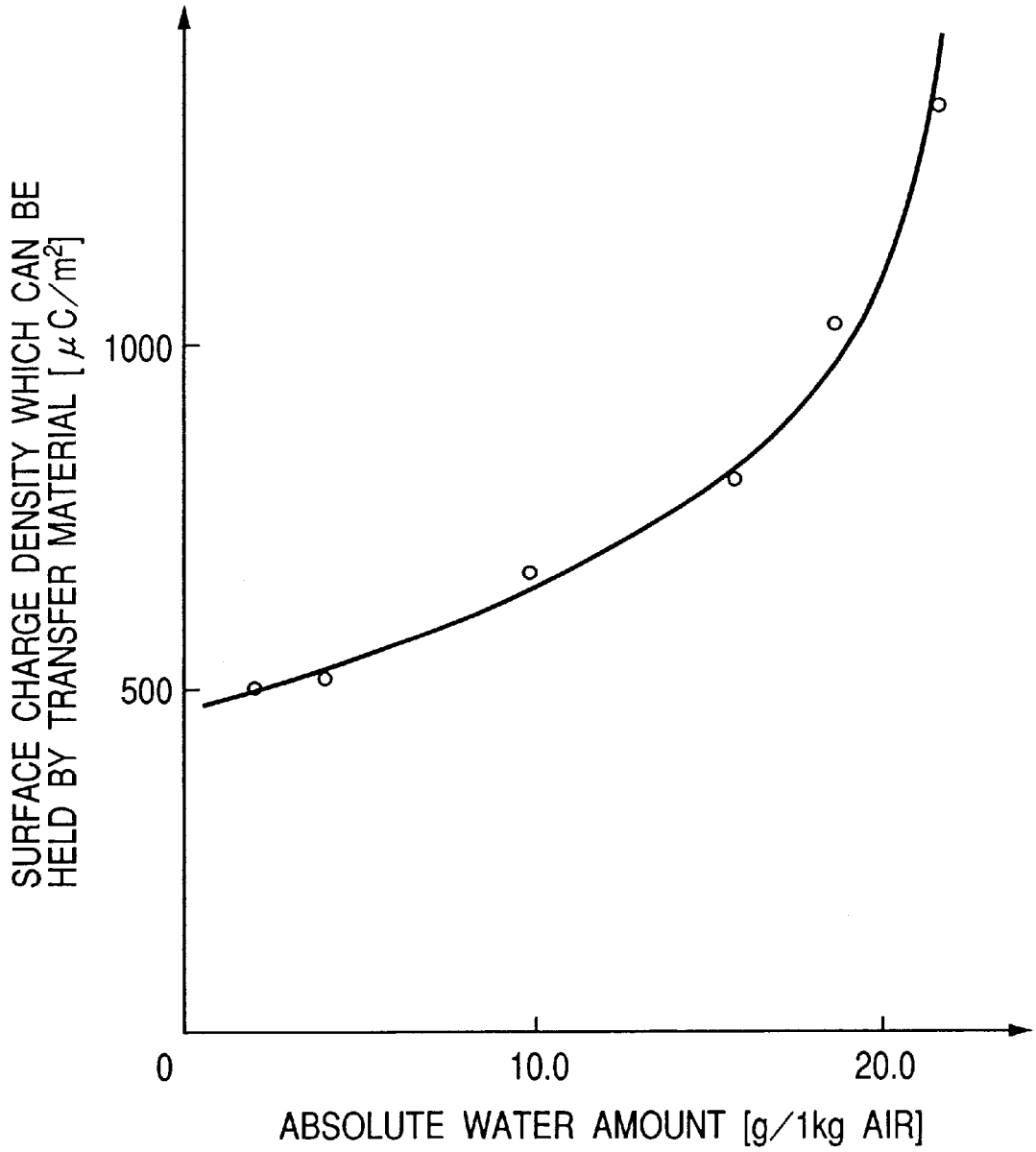
FIG. 11 is a graph showing a relation between the absolute water amount of environmental ambience and the maximum retainable surface charge density of a transfer material.
Figure 12:
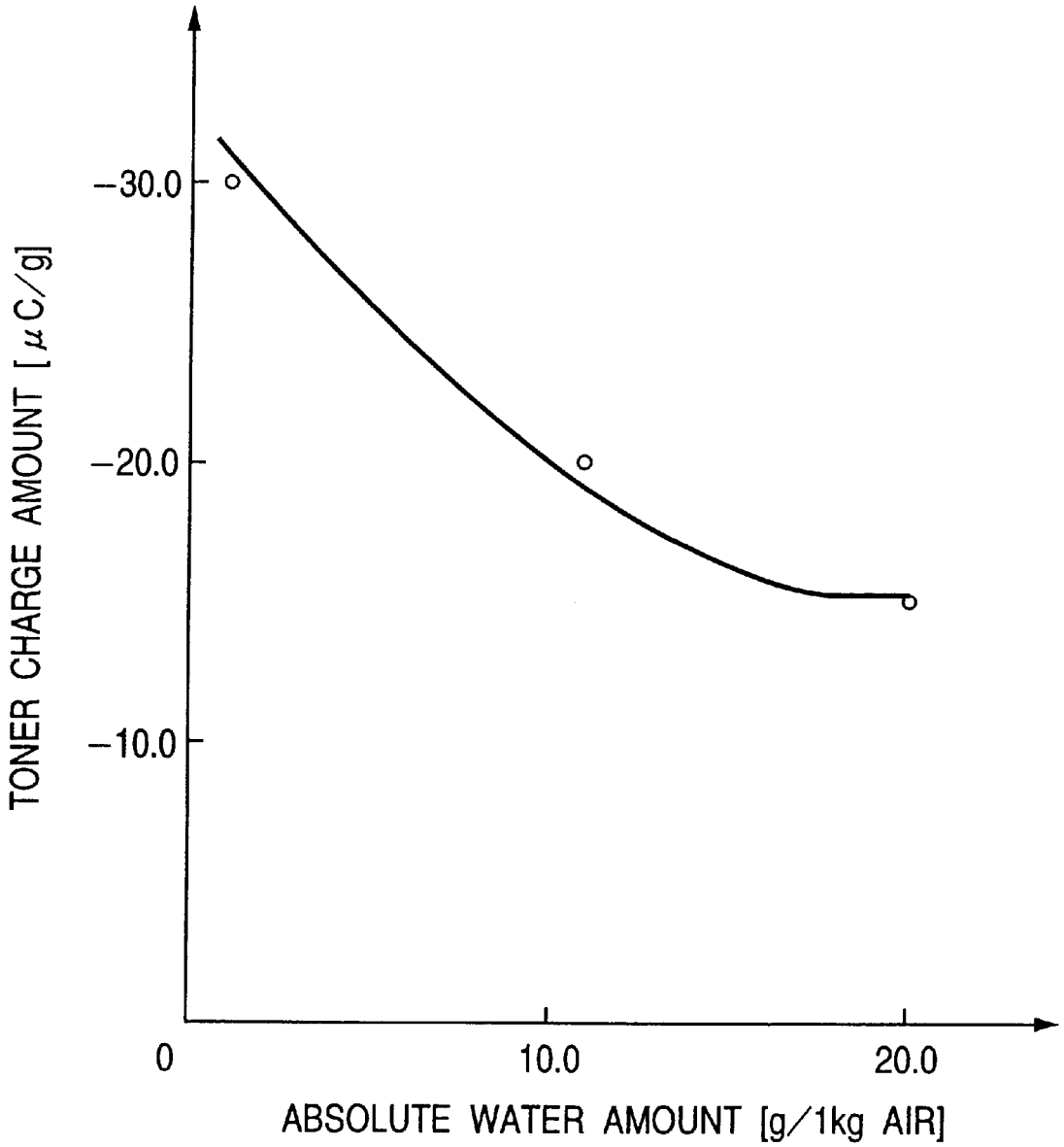
FIG. 12 is a graph showing a relation between the absolute water amount of environmental ambience and the toner charge amount per unit weight.

Besides, FIG. 11 shows a relation between varied absolute water contents of environmental ambience and the maximum retainable charge density of a transfer material.

The transfer material shown in this graph is PB-SK paper manufactured by Nippon Paper Industries Co., Ltd. (basis weight: 64 g/m$^2$) identical to those shown in FIGS. 9 and 10. As well understood from reference of FIG. 11, it has become clear that there is a strong correlation between the retainable surface charge density of the transfer material and the environmental ambience, i.e. the absolute water content in air and that the retainable surface charge density of the transfer material decreases with decreasing absolute water content.

When the occurrence mechanism of the problems in the related background art is re-investigated with the charge amount of toner actually used for image forming also taken into consideration, the following conclusion can be obtained.

In case of using the two component developing method, the charge amount of toner stuck to a photosensitive drum by developing is about −30 $\mu$C/g under a normal temperature and low humidity environment of 23° C./5% and the toner bearing amount needed for a solid image portion (i.e. maximum image density portion) is 0.01 kg/m$^2$. Meanwhile, four colors of toner are to be superposed in the execution of a full-color image forming and the upper limit value of toner bearing amount per unit area at this time depends on the fixing conditions and the image processing method, but is often set to about double that of the monochrome image forming time. Thus, the maximum surface charge density amount to −600 $\mu$C/m$^2$ for the full-color image forming.

On the other hand, in case of using the above PB-SK paper manufactured by Nippon Paper Industries Co., Ltd. (basis weight: 64 g/m$^2$) as transfer material, since the absolute maximum retainable surface charge density was 500 $\mu$C/m$^2$ under this normal temperature and low humidity environmental ambience of 23° C./5%, a toner charge of −100 $\mu$/m$^2$ is calculated to be unretainable. It is consideredithat an abnormal discharge is generated and image faults are caused by this unretainable charge.

Namely, under normal temperature and low humidity environment, a transfer material is very apt to cause an electric change in characteristics and reaches no surface electric potential of above predetermined amount. In other words, it becomes impossible to retain a surface charge of above predetermined amount on the surface of a transfer material and when an attempt is made to transfer a toner image formed on an image bearing member to a transfer material, the total charge amount of toner increases and the transfer electric field corresponding thereto is applied to the transfer material. In this case, it is considered that an abnormal discharge becomes likely to be generated, thereby bringing about image faults, because the transfer material cannot retain a charge of a predetermined amount or above.

The above content will be expressed in terms of Equation as follows.

First, let the maximum retainable surface charge amount Qp (C/m$^2$) be a value of function Qp=Qp (s, k) given with the type of a transfer material and the placed environmental ambience thereof taken as variables, where s and k are the type of a transfer material and the absolute water content (g/1 kg air) of an environmental ambience, respectively.

Next, letting the charge Qt amount per unit weight of toner be a value of function Qt=Qt (k) given with the environmental ambience taken as variable and letting M (kg/m$^2$) be the weight of toner transferred to a transfer material per unit area, the following relational formula (1) can be obtained:

$$Qp(s, k) \geqq M \cdot Qt(k) \quad (1)$$

If the relation of formula (1) is satisfied, the surface charge density due to the transfer electric field given to a transfer material never exceeds the retainable upper limit of the transfer material, so that the generation of an abnormal discharge is prevented and image faults due to abnormal discharge can be eliminated.

To summarize, when a transfer material falls into such a condition as if placed in the above normal temperature and low humidity environment, the occurrence of image faults due to abnormal discharge can be prevented, thus enabling a good image to be obtained, by restricting the amount M of toner to be transferred to the transfer material per unit area.

Thus, according to the present invention, a temperature/humidity sensor 320 capable of measuring the temperature and humidity is provided in the main body of an image forming apparatus and moreover as nearest to a transfer material store cassette 330 as possible. In response to a temperature/humidity reduction in the apparatus detected by this temperature/humidity sensor 320, the toner amount transferred to a transfer material, accordingly the toner amount of a toner image formed on a photosensitive drum is so arranged to decrease.

To what extent the toner content is decreased is based on the above Equation (1), but to be specific, proceeds preferably in accordance with the following procedure.

By using the detected values of temperature and humidity by temperature/humidity sensor 320, the absolute water content is evaluated according to a well-known calculation formula and from the absolute water content, the retainable surface charge amount of toner transferred to a transfer material is deduced in accordance with the relation between the absolute water content and the retainable surface charge density of the transfer material as shown in FIG. 11. Account is taken of this density, the charge amount per weight of toner found from the absolute water content and the ratio of the transfer charge given to the transfer material for the transfer of toner to the charge amount provided for the actual toner transfer and the weight of toner transferable to the transfer material per unit area is determined. By the portion greater of the toner formed on the image bearing member than the value found from this calculation, the toner amount per unit area formed on the photosensitive drum 301(transfer material) has only to be reduced.

A numerical example of this embodiment will be demonstrated as follows.

When temperature/humidity near the transfer material store cassette 330 in the apparatus is detected to be 23° C./5% by use of temperature/humidity sensor 320, the absolute water content is calculated to be 0.5 g/1 kg air and the absolute maximum retainable surface charge density Qp of this transfer material is computed at 500 $\mu C/m^2$. On the other hand, the charge amount per unit weight of toner Qt for 23° C./5% is also computed at −30 $\mu C/g$. Thus, it follows from the above formula (1) that $M \leqq 16.7$ g/m$^2$ (1.67 mg/cm$^2$). Assuming that the standard setting value is 20.0 g/m$^2$, it is required to reduce this value below 16.7 g/m$^2$. Since $100-(16.7/20.0\times100)=16.5\%$, the toner bearing amount has only to be reduced by 16.5% or more from the standard setting value. In this case, the toner bearing amount of a monochrome solid image is preferably set to 8.3 g/m$^2$ or less.

In this embodiment, means for adjusting Vcont was employed as means for modifying the above toner bearing amount. Besides, the toner bearing amount, i.e. the toner amount of a toner image formed on the photosensitive drum 1, is evaluated by installing an unshown density sensor and detecting the density of the toner image formed on the photosensitive drum 301. The density sensor develops a monochrome solid image at the other portion than the image of the photosensitive drum and irradiates a light beam from over the relevant image onto the photosensitive drum to detect its reflected light, but may be replaced with a sensor of other system.

Besides, according to this embodiment, the relation between the reflected light amount and either the density or the toner bearing amount is set up in advance and Vcont is so arranged as adjustable after the bearing amount is estimated directly from the reflected light amount detected above. Although the relation between the maximum toner bearing amount on the photosensitive drum and Vcont is set up in advance, Vcont is so arranged as to be automatically adjusted and reset to the target bearing amount if the bearing amount greatly deviates from the target value as a result of the above measurement.

However, the means for modifying the toner bearing amount is not limited to the above Vcont, but needless to say, the exposure amount to the photosensitive drum or other developing conditions may be modified.

A brief description will be made of Vcont in this embodiment. By means of charging means 331, the photosensitive drum 301 is uniformly charged. Let Vd be this charged potential. On this photosensitive drum 301, image exposure is performed by an LED solid scanner 140 and the electric potential of this exposed portion rises. Let Vl be the electric potential on the photosensitive drum 301 which to form a monochrome solid image on. In contrast, letting Vdc be the developing bias, important factors are defined in such representations as Vcont=Vl−Vdc and Vback=Vdc−Vd. Toner is stuck to the photosensitive drum 301 so as to fill up the potential difference between Vl and Vdc. Thus, by changing a value of Vcont, the maximum toner bearing amount per unit area can be modified.

Taking the case of a blue image as one example, a further description will be made. In this embodiment, monochrome solid images are to be multiply transferred in the sequence of magenta and cyan on the intermediate transfer belt 382, but in such a case, the maximum toner bearing amount M on a transfer material have only to be equally divided in halves for the respective bearing amounts of individual colors. That is, it is only necessary to set the toner bearing amount of magenta to be developed first and that of cyan to be developed secondly to 8.3 g/m$^2$ and 8.3 g/m, respectively.

Here, the maximum toner amounts per unit area of magenta and cyan was allotted at a ratio of ½, but that of magenta may be so arranged as to be greater than that of cyan in case of a blue image considering a difficult tendency of transfer for the toner layer formed at the upper layer on a transfer material, i.e. the toner layer formed at the lower layer on an intermediate transfer belt 382. Furthermore, in the above representative examples, a case of reducing the toner bearing amount to as great extent as 13.5% was described, but if this extent of reduction is slight, e.g. on the order of 2 to 4%, an arrangement may be taken in which only the toner bearing amount of cyan forming a toner image at the lowermost layer is reduced.

As a quite preferable arrangement of this embodiment, a plurality of relational expressions between the absolute water content and the retainable surface charge density as shown in FIG. 11 are stored corresponding to the types of transfer materials in the main body of the apparatus. On inputting the type of a transfer material in advance to the main body of the image forming apparatus, an apparatus user estimates the maximum retainable surface charge density for every transfer material stored in the main body of the apparatus from this input information using the image forming apparatus. As mentioned above, needless to say, if the user determines the toner amounts per unit area of individual toner images formed on the image bearing member on the basis of information about temperature/humidity in the main body of the apparatus, quite preferable results are obtained.

Embodiment 5

In this embodiment, when the maximum toner bearing amount per unit area is changed, the transfer electric current value in the transfer from the intermediate transfer belt 382 to a transfer material P of FIG. 8 is so arranged as variable correspondingly. The other points of arrangement in this embodiment are basically the same as with Embodiment 4.

Reduction of a toner bearing amount permits the transfer electric current value required for the transfer of toner to be also reduced. Supply of a greater amount of transfer electric current than required induces an abnormal discharge in and near the transfer nip and causes image faults. Thus, it is preferable to make a transfer at the necessary possible minimum of transfer charge supply.

Formerly, under conditions comprising normal temperature and low humidity environment (23° C./5%), a toner charge amount of −30 $\mu$C/g a maximum toner bearing amount per unit area of 20 g/m$^2$, a transfer electric current of +24 $\mu$A was needed, but if the toner bearing amount is reduced by about 13.5% as in Embodiment 4, a transfer is fully executable at only a transfer electric current of about +20 $\mu$A. Thus, in this embodiment, the transfer electric current is reduced in such a manner.

Furthermore, as described in Embodiment 4, if the maximum toner bearing amount per unit area for every color is changed, it is quite preferable that a value of transfer electric current vary with individual color.

In this embodiment, a table of the maximum retainable charge amount per unit area of a transfer material under individual environments and the toner charge amount under individual environments, e.g. ROM as storage medium can be used to set up a value of required transfer electric current.

With this embodiment, because of being so arranged as mentioned above, effects similar to those of Embodiment 4 are obtained and an abnormal discharge originating from an excess supply of transfer charge to a transfer material is prevented, thus enabling its resultant image faults to be also eliminated.

Embodiment 6

This embodiment is also similar in basic arrangement to Embodiments 4 and 5 as described above. This embodiment is characterized by automatically detecting the condition of a transfer material and by making the maximum toner bearing amount per unit area variable corresponding to the detected results.

This embodiment is so arranged as to detect the condition of a transfer material in the secondary transfer position extending from an intermediate transfer belt 382 to a transfer material P. A method for detecting the condition of transfer material comprises moving the transfer material to the secondary transfer position without transferring a toner image onto the intermediate transfer belt, applying a predetermined current (constant-current control) to a transfer roller 372 and detecting the transfer voltage at this time apart from the ordinary image forming.

Namely, transfer voltages for a secondary transfer electric current I0 and for a secondary transfer current I1 greater by ΔI than the current I0 are measured and the differential ΔV1 of these transfer voltages is computed. Furthermore, a transfer voltage for a secondary transfer current I2 greater by ΔI than the current I1 are measured and the differential ΔV2 of these transfer voltages is computed. These differentials ΔI1 and ΔI2 of transfer voltages are normally constant, but ΔVi (i=1, 2) begins to decrease once the supply charge amount to the transfer material exceeds the retainable charge amount of the transfer material. Such being the case, the secondary transfer current immediately prior to the beginning of decrease in ΔVi is found from the above detection flow, the maximum retainable charge amount of the transfer material is inferred from this value of secondary transfer current, so that the maximum toner bearing amount capable of forming images is determined.

By such an arrangement, the maximum toner bearing amount and secondary transfer current can be automatically modified without input of the type of a transfer material.

However, strictly speaking, the above means is only one means for automatically detecting the maximum retainable charge amount of a transfer material and may be replaced with other means. For example, an arrangement in which output of the secondary transfer high-voltage power supply for a transfer roller 372 is controlled to a constant voltage and electric current at that time can be detected is allowable or another arrangement in which the water content of a transfer material is detected by using an infrared water content meter and the maximum retainable charge amount of a transfer material is automatically detected from the relation between the water content of the transfer material and the maximum retainable charge amount is also thinkable.

Embodiment 7

By using the image forming apparatus shown in FIG. 13, hereinafter, this embodiment will be described.

Figure 13:
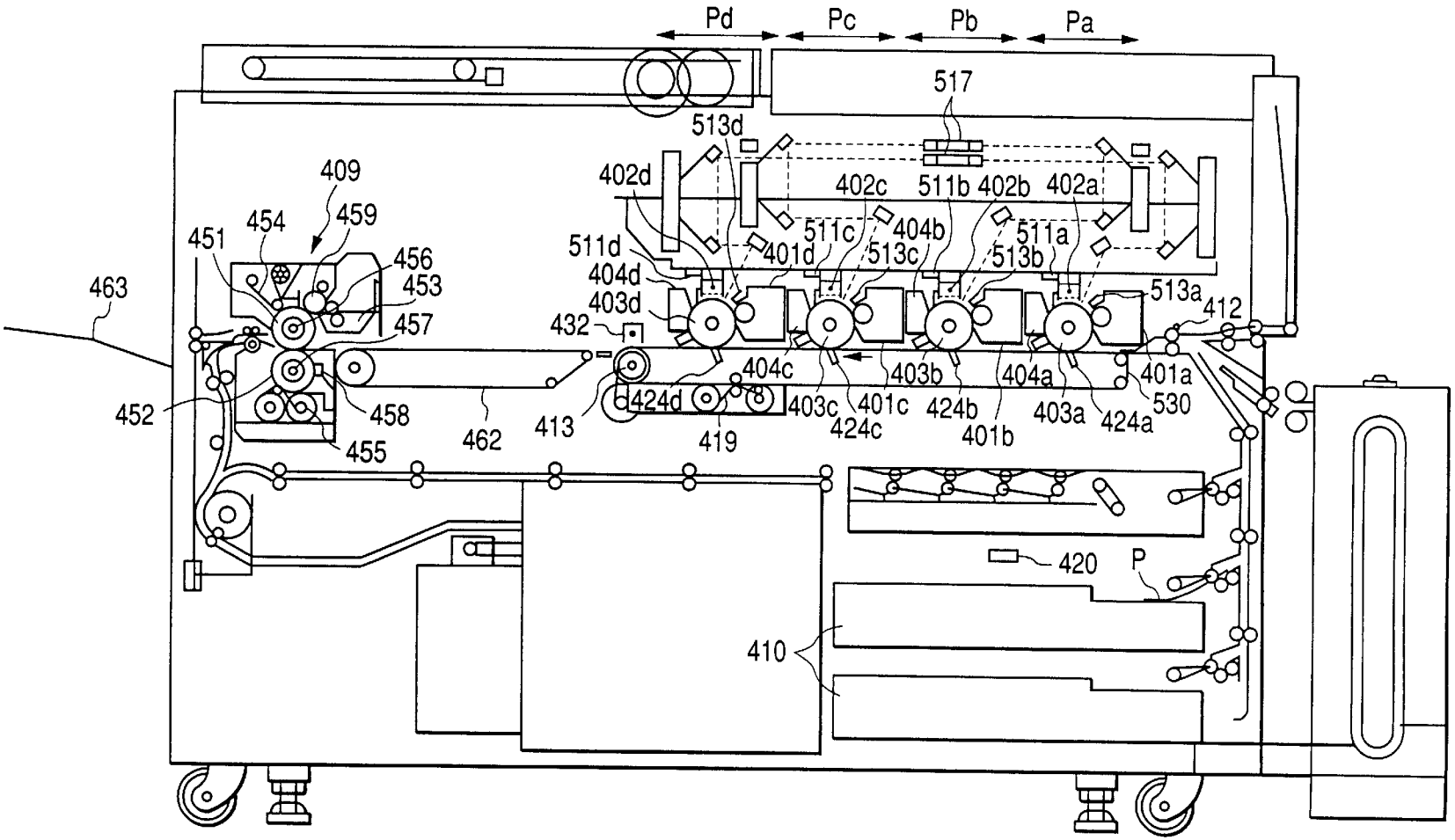
FIG. 13 is a structural view showing an image forming apparatus to which the present invention is applicable.

As shown in FIG. 13, a first, a second, a third and a fourth image forming sections Pa, Pb, Pc and Pd are provided side by side in the apparatus, in each of which its toner image of different color from others is formed through the processes of latent image forming, development and transfer.

The image forming sections Pa, Pb, Pc and Pd are equipped with their exclusive image bearing members, in this example, electrophotographic photosensitive drums 403*a*, 403*b*, 403*c* and 403*d*, respectively and on individual photosensitive drums 403*a*, 403*b*, 403*c* and 403*d*, the respective color toner images are formed. Adjacently to all these photosensitive drums 403*a*, 403*b*, 403*c* and 403*d*, a transfer belt 530 as transfer material bearing member is installed and the respective color toner images formed on the photosensitive drums 403*a*, 403*b*, 403*c* and 403*d* are borne and conveyed on the transfer belt 530 and superposed and transferred onto a transfer material P on top of each other.

After the fixing of toner images by heating and pressurizing in a fixing device 409, the transfer material P with individual color toner images transferred thereto is discharged from the apparatus outward as color recorded image.

At the outer peripheries of individual photosensitive drums 403*a*, 403*b*, 403*c* and 403*d*, exposing lamps 511*a*, 511*b*, 511*c* and 511*d*, drum charger 402*a*, 402*b*, 402*c* and 402*d*, electrostatic voltmeter 513*a*, 513*b*, 513*c* and 513*d*, developing units 401*a*, 401*b*, 401*c* and 401*d*, transfer chargers 424*a*, 424*b*, 424*c* and 424*d*, and cleaners 404*a*, 404*b*, 404*c* and 404*d* are respectively provided and at the top of the apparatus, an unshown light source device and a polygon mirror 517 are further provided.

By rotating a laser beam emanated from the light source device through aids of the polygon mirror 517 for scanning, deflecting a flux of scanning light through aids of the reflection mirror condensing the flux in generating line directions of individual photosensitive drums 403*a*, 403*b*, 403*c* and 403*d* through aids of fθ lenses for exposure, electrostatic latent images corresponding to image signals are formed on individual photosensitive drums 403*a*, 403*b*, 403*c* and 403*d*.

In the developing units 401*a*, 401*b*, 401*c* and 401*d*, cyan, magenta, yellow and black toner are respectively filled at a predetermined amount as developers by unshown supply devices. The developing units 401*a*, 401*b*, 401*c* and 401*d* develop the respective latent images on the photosensitive drums 403*a*, 403*b*, 403*c* and 403*d* under application of a predetermined developing bias and visualizes them as a cyan toner image, magenta toner image, yellow toner image and black toner image.

A transfer material P is stored in a transfer material cassette 410. The transfer material P is supplied therefrom through a plurality of conveying rollers and a registering roller 412 onto the transfer belt 530 and successively sent to the transfer sections opposed to the photosensitive drums 403*a*, 403*b*, 403*c* and 403*d* by the conveyance using the transfer belt 530.

The transfer belt 530 is made up of sheets of dielectric resin such as polyethylene terephthalate resin (PET), polyfluoride vinylidene resin or polyurethane resin and belts of endless shape made by joining sheets with adjacent ends overlapped or seamless belts are employed.

Meanwhile, when this transfer belt 530 is rotated by the driving roller 413 and is confirmed to be positioned at a predetermined position, a transfer material P is fed from the registering roller 412 to the transfer belt 530 and conveyed to the transfer section of the first image forming section Pa. Simultaneously to this, an image write signal turns ON and image forming is carried out to the photosensitive drum 403*a* of the first image forming section Pa at a certain timing based on this signal.

And, on application of an electric field or charge by the transfer charger 424*a* in the transfer section below the photosensitive drum 403*a*, a first color toner image formed on the photosensitive drum 403*a* is transferred onto the transfer material P. By this transfer, the transfer material P is firmly borne on the transfer belt 530 by an electrostatic adsorbing force and conveyed to the second image forming section Pb and the subsequent sections.

For the transfer charger 424 (424*a* to 424*d*), a noncontact charger such as corona discharger or a contact charger using a charging member such as conductive blade, roller and brush is employed. The noncontact charger has problems that ozone is generated and no image is formed stably on account of a large dependence on temperature and humidity changes in atmosphere originating in charging method via air. The contact charger has no such problems and has merits of absence of ozone, resistance to temperature and humidity changes, high image quality and so on. In this embodiment, a contact charger is used for the transfer charger 424.

Image forming and transfer in the second to fourth image forming sections Pb to Pd are also performed as with the first image forming section Pa. Then, the transfer material P to which four color toner images are transferred is separated from the end of the transfer belt 530 by removing electricity by a charge separator 432 at the downstream in the conveying direction of the transfer belt 530 to attenuate electrostatic adsorbing force. Normally, the driving roller 413 is connected to the ground to make a stable separation. Besides, for the charge separator 432, a noncontact charger is employed because charge is eliminated from the transfer material P with toner images kept unfixed.

The transfer material P separated from the transfer belt 530 is conveyed to the fixing device 409 by the conveyance section 462. The fixing device 409 comprises a fixing roller 451, a pressurizing roller 452, heat-resistant cleaning members 454 and 455 for respectively cleaning the above rollers, heating heaters 456 and 457 installed in the fixing roller 451 and 452, an application roller 459 for applying a molding lubricating oil such as dimethyl silicone oil to the fixing roller 451, an oil basin 453 and a thermistor 458 for sensing the temperature of the surface of the pressurizing roller 452 to control the fixing temperature.

After color mixing and fixing to the transfer material P of toner images by fixing and forming a full-color copy image, the transfer material P with four color toner images is discharged to a discharge tray 463.

After transfer remaining toner is cleaned and removed by each cleaners 404*a*, 404*b*, 404*c*, and 404*d*, the photosensitive drums 403*a*, 403*b*, 403*c* and 403*d* after the completion of transfer are made ready for a step of forming the next latent images and the subsequent steps continuously. Toner and other foreign matters remaining on the transfer belt 530 are so arranged as to be wiped off with a cleaning web 419 (non-woven cloth) abutting against the surface of the transfer belt 530.

As mentioned above, the transfer belt 530 used in the image forming apparatus arranged thus is a dielectric material sheet such as PET sheet, polyfluoride vinylidene sheet or polyurethane sheet as mentioned above and volume resistance of these materials preferably ranges from $10^{13}$ Ωcm to $10^{18}$ Ωcm.

Besides, since image formation is stabilized with electric current contributing to transfer (transfer electric current) kept constant in proper current, the transfer chargers 424 (424*a* to 424*d*) undergo a constant-current control so that a constant current is obtained even if volume resistance varies with types of transfer materials (such as thickness and material quality), hygroscopic conditions or the like.

The transfer section comprises a transfer charger, driving means for driving the transfer charger and detecting means for detecting the width of a transfer material and the process speed is 100 mm/sec.

The contact transfer charger 424 (424*a* to 424*d*) has a transfer member made of platelike conductive rubber extending in a direction perpendicular (thrust direction) to the direction of conveying a transfer material and this transfer member is pushed so as to contact the photosensitive drums 403 (403*a*, 403*b*, 403*c* and 403*d*) via the transfer belt 530. By this transfer charger 424, charging opposed in polarity (in this example, plus) to toner images on the photosensitive drum 403 is accomplished from the back face side of the transfer material P conveyed to the transfer section and toner images on the photosensitive drum 403 is electrostatically transferred to the surface of a transfer material P. With this embodiment, electric current flowing through a transfer charger 424 undergoes a constant-current control so as to set transfer electric current to 10 μA (in the case of a corona charger, the difference between electric current flowing through the corona charger and electric current flowing through the shield becomes transfer electric current).

The charge separator 432 is disposed above the downstream-most of the transfer belt 530, i.e. above the driving roller 413 of the transfer belt 530 and equipped with a discharge wire. The discharge wire is spanned in the thrust direction and the tension is kept by the provision of a spring at one end portion of the discharge wire. Power supply to the discharge wire is performed through unshown electric supply terminals, electric supply pins and a spring from the connector on the side of the main body of the apparatus.

Besides, the driving roller 413 is connected to the main body ground and jointly serves for the function of the opposite electrode of the discharge wire. In this embodiment, the distance between the transfer charger 424*d* of the image forming section Pd at the final stage and the separating charger section is 50 mm and to the separating charger 432 is applied an AC voltage of 10 kvpp.

Besides, in this image forming apparatus, after images are formed on the first surface of a transfer material P and after a toner image is fixed on the transfer material P by the fixing device 409, the transfer material P is not discharged from the apparatus outward and conveyed to the surface reverse tray. Thereafter, the transfer material P is conveyed from the surface reverse tray to the image forming sections Pa to Pd and images are so arranged as capable of forming images on the second surface opposed to the first surface in the transfer material P. That is, images are so arranged as capable of being formed on both surfaces of the transfer material P.

Meanwhile, transfer materials (paper) used in an image forming apparatus as mentioned above significantly vary in condition with temperature/humidity during the stock. Examinations of the present inventors has revealed that there is a great difference in electric characteristics between paper immediately after the opening of a package and paper with significantly reduced water content as a result of heating once by a fixing device. Namely, it has been found that, when the water content is reduced, paper has a limit to the retainable charge amount on the front surface and the back surface of the paper.

Figure 14:
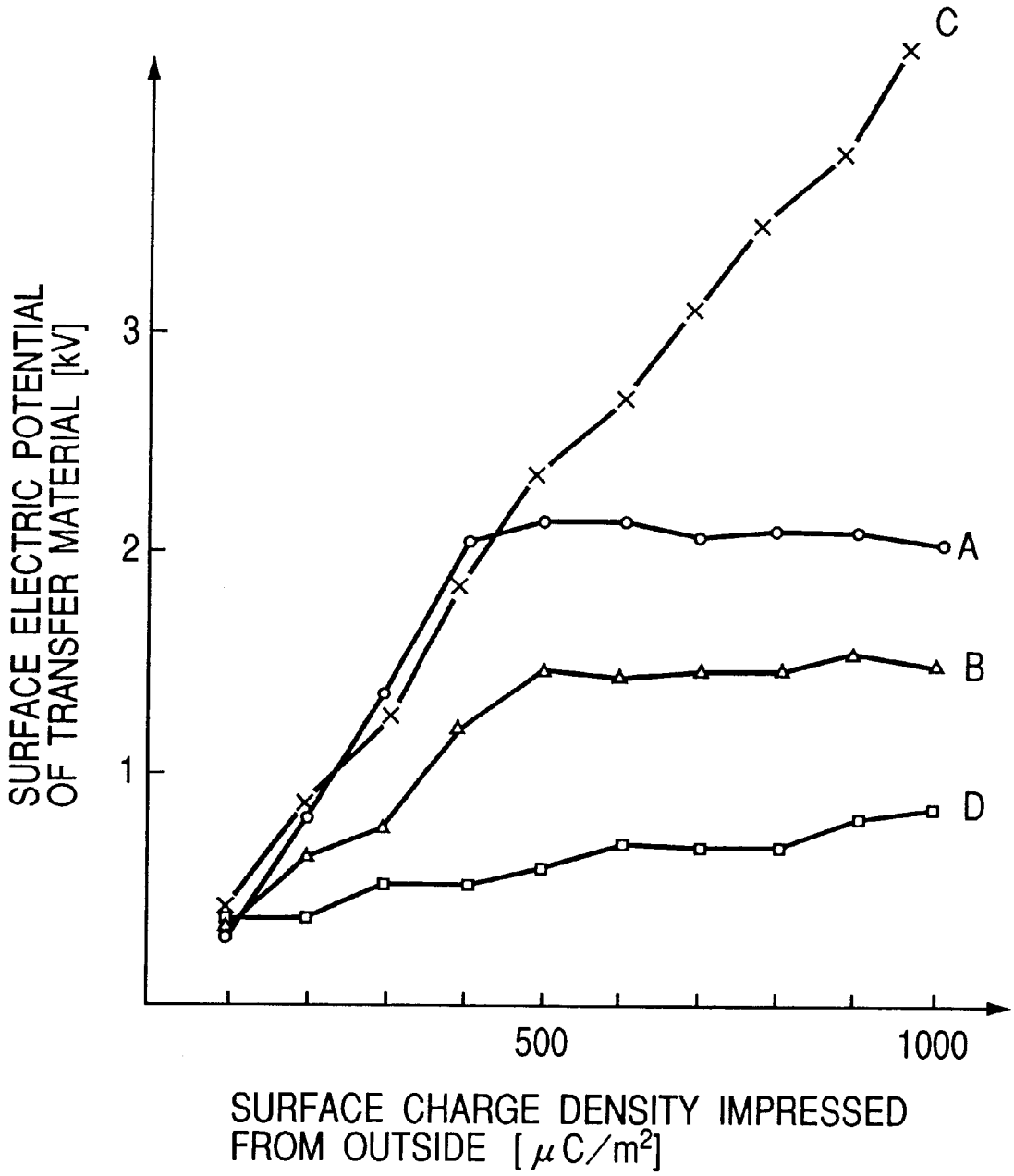
FIG. 14 is a graph showing relations between the surface charge density imposed on a transfer material and the surface electric potential thereof.

FIG. 14 is a correlation graphic representation between the surface charge density externally imposed on a transfer material and the surface electric potential thereof. In FIG. 14, Graph C shows a result obtained when using OHT (made of PET sheet; thickness: 100 $\mu$m). The OHT, in which the surface electric potential linearly rises with an increase in supplied charge amount, fulfills a role of ideal capacitor. Besides, Graph D shows the result obtained when using paper immediately after the opening of a package and this case indicates a linear rise in surface electric potential with an increase in supplied charge amount as with the graph C though the gradient is lower and therefore is also ideal.

On the other hand, Curve A shows the result obtained when using fine paper NPI available from Haga sheet shop (basis weight: 128 g/m$^2$; thickness: 120 $\mu$m) after passed through the fixing device and Curve B shows the result obtained when using CLC double-sided thick sheet manufactured by Canon Inc. (basis weight: 105 g/m$^2$; thickness 100 $\mu$m), respectively. It is found from these that a linearity loses from near 450 $\mu$C/m$^2$ and from near 500 $\mu$C/m$^2$ respectively for Curve A paper and Curve B paper, which tendency is not observed in paper immediately after the opening of a package (Curve D) or in OHT (Curve C).

This tendency is attributable to the fact that, after reduction of the water content in paper by passing once through a fixing device, occurrence of discharge in minute gaps between the fibers of paper at the supply of charge to the surface of paper results in charge cancellation on the front surface and the back surface of paper and consequently charge cannot be accumulated and the surface electric potential does not rise however more charge may be supplied.

Also in the above image forming apparatus, after the formation of an image on a second surface of such paper passed through a fixing device, the retainable charge amount of paper reaches a limit when charge is supplied above a certain extent through several transfer steps, then in-paper electric discharge as mentioned above begins, paper abruptly loses in retaining power of toner and point-shaped image faults take place on a second surface of paper (transfer material) as described in Related Background Art.

According to FIG. 14, the maximum retainable charge amount of paper passed once through a fixing device is about 500 $\mu$C/m$^2$.

Here, in an image forming apparatus, setting the maximum toner bearing amount per unit area for one color and the charge amount per unit weight of toner to 1 mg/cm$^2$ and 30 $\mu$C/g, respectively, a toner charge of 300 $\mu$C/m$^2$ is given onto paper after the completion of each transfer step. This suggests how many colors of toner images are transferable for paper shown with Curves A and B of FIG. 14.

Since $300 \times x \leqq 500 \therefore x \leqq 1.67$, it is found that only about 1.67 colors of toner images is transferable at the very most.

Generally, in a color image forming apparatus, UCR (Under Color Removal) is adopted for reasons of difficulty in reproduction of black by using 3 colors of cyan, magenta and yellow, a desire of saving the toner amount and so on. To be specific, UCR means a way to replace the common portion (black component) of cyan, magenta and yellow with black and reduce this portion from cyan, magenta and yellow to be used. Not to mention the promotion of black reproducibility, adoption of UCR permits the saving of toner amount to great extent as well.

Although depending on apparatuses, usually, image forming is accomplished at a toner amount of 2 color use or so as the total maximum amount. UCR is also adopted in this embodiment and the total amount of maximum transfer toner is set to the toner amount of 2 color use. However, the total amount exceeds the above amount of 1.67 color toner images. Under the present circumstances, occurrence of a poor transfer in the shape of points as mentioned above is inevitable when a transfer is made again onto paper passed once through a fixing device.

Thus, as a result of examinations of the present inventors, it has been found that by reducing the toner amount of a toner image for a second surface formed on a photosensitive drum, in the case when a transfer is made again onto paper passed once through a fixing device, i.e. a transfer is made on a second surface of a paper, occurrence of a poor transfer in the shape of points as mentioned above can be prevented and a good image can be obtained. Hereinafter, this method will be described.

Referring to FIG. 14, the maximum retainable charge amount per unit area Qp (C/m$^2$) of a transfer material is a value of function Qp=Qp (s, k) given with types of transfer materials and placed environmental ambience thereof taken as variables, where s and k are type of a transfer material and the absolute water amount (g/1 kg air) of environmental ambience. In the transfer material demonstrated with Curve B of FIG. 14, for example, Qp is about $5 \times 10^{-4}$ C/m$^2$.

Besides, the charge amount Qt (C/kg) per unit weight of toner is a value of function Qt=Qt (k) given with environmental ambience taken as variable and the UCR upper limit value is set to n colors. In this embodiment, Qt=$3 \times 10^{-2}$ C/kg and n=2 colors. The weight per unit area of toner on a photosensitive drum (toner bearing amount) is set to M (kg/m$^2$).

At this time, since the toner charge amount after the formation of 4 color images is M·Qt (k)·n (C/kg), the charge amount per unit area on the front surface/back surface of a transfer material becomes ±M·Qt (k)·n (in this embodiment, plus and minus corresponds to the back surface and the front surface of a transfer material, respectively, because of using negative toner).

In order that a poor transfer in the shape of points as mentioned above is prevented from occurring, a value of this M·Qt (k)·n (C/kg) has only not to exceed that of Qp (s, k). Namely, the toner amount M on a photosensitive drum has only to lie in a range that $$M \cdot Qt(k) \cdot n \leqq Qp(s, k)$$

$\therefore M \leqq Qp(s, k)/Qt(k)/n.$

Here, the maximum retainable charge amount per unit area of a transfer material Qp (s, k) is greatly dependent on type of paper and operating environment, especially on temperature/humidity of the main body of an image forming apparatus.

Figure 15:
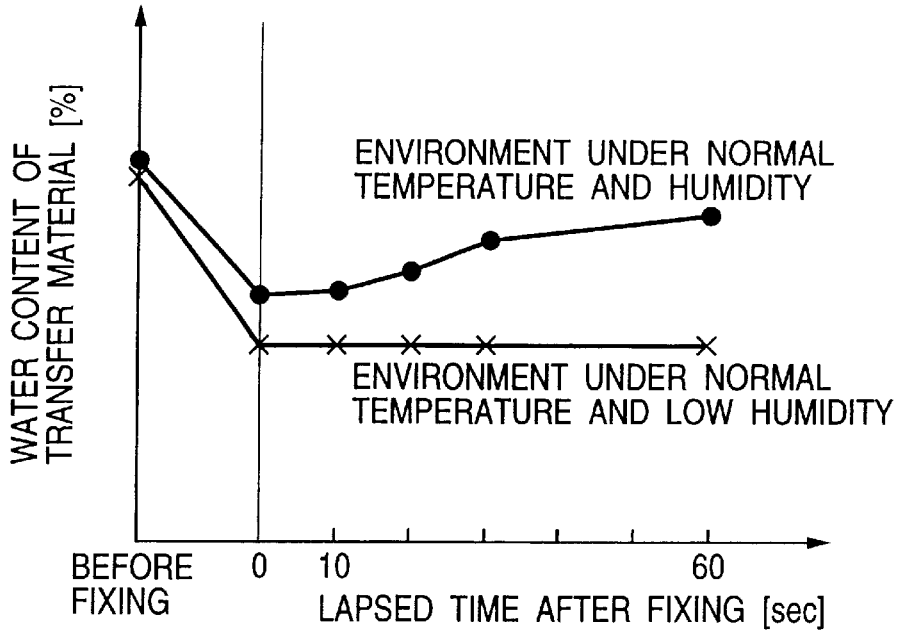
FIG. 15 is a graph showing changes in the water content of a transfer material after fixing.

FIG. 15 shows a change in the water content observed when a transfer material passed once through a fixing device left alone under normal temperature and normal humidity (23° C., 60% RH) environment and under normal temperature and low humidity (23° C., 5% RH). The water content of the transfer material is measured using an infrared water content meter KJT100 manufactured by Kett Electric Laboratory, Inc.

As shown in FIG. 15, the water content reduces on the order of 2 to 3% on passing a transfer material once through a fixing device. Thereafter, in transfer material left alone under normal temperature and normal humidity, the water content is recovered to the order of nearly 80% of the initial one by moisture absorption after the lapse of 30 sec, whereas no tendency of moisture absorption is observed even after the lapse of 60 sec in transfer material left alone under normal temperature and low humidity.

In this embodiment, since the time taken from the completion of fixing for the first surface of a transfer material to the initiation of a first color transfer for the second surface is about 15 sec, the water content of the transfer material for the second surface is understood to be greatly dependent on the placed environmental ambience of paper.

Figure 16:
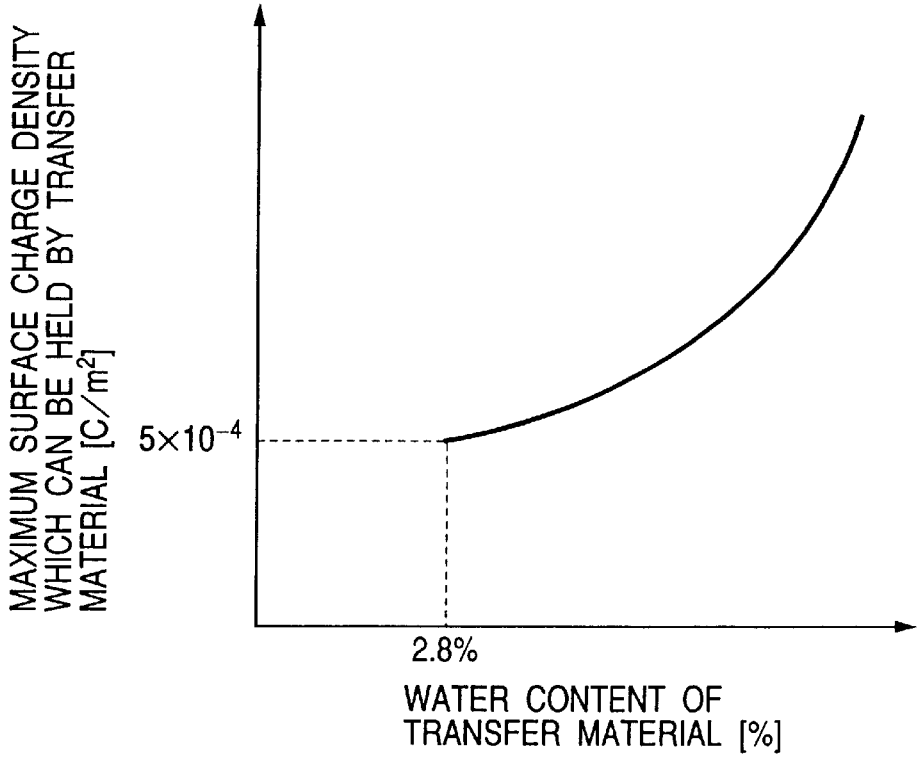
FIG. 16 is a graph showing a relation between the water content of a transfer material and the maximum retainable surface charge density of the transfer material.

FIG. 16 shows a relation between the water content and the maximum retainable surface charge density of a transfer material. As evident from FIG. 16, the maximum retainable surface charge density of a transfer material, strongly relative to the water content thereof, is found to be reduced with a decrease in water content.

Thus, a temperature/humidity sensor 420 capable of measuring temperature and humidity is provided nearest possible to a transfer material store cassette 410 in the main body of an image forming apparatus, the absolute water content in the apparatus is evaluated by using the temperature/humidity in the apparatus detected by the temperature/humidity sensor 420 to estimate the maximum retainable surface charge density for the second surface of the transfer material therefrom and it is decided to reduce the toner amount transferred onto the second surface of the transfer material, i.e. the toner amount of a toner image for the second surface formed on a photosensitive drum 403.

To what extent the toner amount should be reduced is preferable determined on the basis of the above formula according to the following procedure. It is advisable to estimate the water content of a transfer material at a first color transfer of the second surface in double-sided image forming as found from FIG. 15 from the detected values of temperature and humidity by use of a temperature/humidity sensor, to evaluate the maximum surface charge density loadable on the second surface of the transfer material from a relation between the water content of the transfer material and the maximum retainable surface charge density as shown in FIG. 16 and to determine the toner amount per unit area from the surface charge density of transfer material and the toner charge amount per unit area inferable from the detected value of the temperature/humidity sensor in accordance with the above formula.

A specific numerical example will be illustrated. In this embodiment, $M \leqq 8.3\times10^{-3}$ kg/m$^2$ is deduced from Qp (s, k)=$5\times10^{-4}$ C/m$^2$, Qt (k)=$3\times10^{-2}$ C/kg and n=2 at the image formation of the second surface in double-sided image forming of a transfer material demonstrated in Curve A of FIG. 14. Thus, at the image forming on the second surface, the toner amount per color has only to be decreased to $8.3\times10^{-3}$ kg/m$^2$.

At this time, it has been revealed by a study of the present inventors that a still better effect is obtained by also reducing the transfer electric current at the same rate as that of a decrease in toner amount. Namely, in this embodiment, since the transfer electric current is 10 $\mu$A for every color, at the transfer on the second surface, the transfer electric current has only to be reduced to $10\times8.3\times10^{-3}/1\times10^{-2}=8.3$ $\mu$A.

As much preferable aspect for this embodiment with as many relational expressions as the number of types of transfer materials as shown in FIGS. 15 and 16, stored in the main body of the apparatus (as ROM), a user inputs the type of a transfer material to the main body of the apparatus in advance for use of an image forming apparatus, estimates the maximum retainable surface charge density for every recording material stored in advance in the main body of the apparatus from the transfer material information and determines the toner weight per unit area on the photosensitive drum according to the above method, then a still better effect would be obviously obtained.

Figure 17:
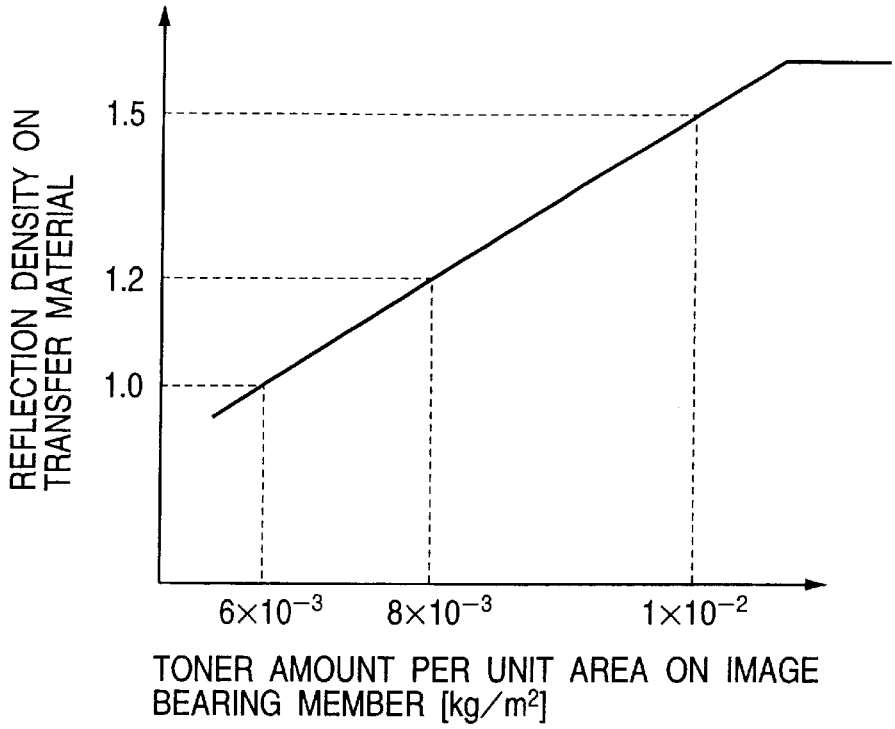
FIG. 17 is a graph showing a relation between the toner amount per unit area of a toner image on a photosensitive drum and the reflection density of the transferred image on a transfer material.

FIG. 17 is a graph showing a relation between the toner amount per unit area of a toner image on a photosensitive drum and the reflection density of the toner image transferred onto a transfer material. From FIG. 17, it follows that the toner amount on a photosensitive drum is proportional to the density of a transfer material and when the toner amount is reduced to prevent a point-shaped transfer defect from occurring, the density on the transfer material lowers naturally. As seen from FIG. 17, however, the density on the transfer material is on the order of 1.2 even if the toner amount is reduced, for example, down to $8\times10^{-3}$ kg/m$^2$ and is sufficiently equal to practical use, so that there is no problem.

In the above, needless to say, it is effective in eliminating the density difference between the first and the second surfaces to keep the toner amount for the second surface within allowable limits. However, there are cases where the toner amount may exceed the maximum retainable charge amount of the transfer material under certain conditions unless significantly reduced. At this time, indeed, a point-shaped transfer defect can be inhibited, but the density is so light for images that there may occur problems in practical use. Thus, in such cases, to secure the necessary minimum density, the toner amount must be kept at least to an extent required for achieving the reflection density >1.0 and in this embodiment, to $6.0\times10^{-3}$ kg/m$^2$ (60% of the initial value).

Namely, if $$Qp(s, k)/Qt(k)/n<6\times10^{-3}$$

in the above formula, it should be set that $$M=Mi\times0.6,$$

where Mi is the initial value of toner amount per unit area of a toner image on a photosensitive drum and in this embodiment, Mi=$1\times10^{-2}$ kg/m$^2$.

As a way of reducing the toner amount, methods of a decrease in the developing contrast electric potential of a latent image, a decrease in exposure amount and such like may be employed.

In the above, a transfer belt was shown as transfer material bearing member, but a transfer drum is available. Besides, as developing units 401 (401*a* to 401*d*), a developing method of any system is allowable.

Generally, developing methods are broadly divided into monocomponent developing methods and two-component developing methods. As monocomponent developing methods, there are a monocomponent noncontact developing method comprising coating the non-magnetic toner onto a developing sleeve by using a blade or the like or coating the magnetic toner onto a developing sleeve under action of a magnetic force, conveying the coated material to a developing section opposed to the image bearing member by rotation of the developing sleeve and developing the toner without contact with the image bearing member and a monocomponent contact developing method comprising developing the toner in contact with the image bearing member. As two-component developing method, there are a two-component noncontact developing method using a two-component developer made of a mixture of toner particles and a magnetic carrier and comprising coating this mixture onto a developing sleeve under action of a magnetic force, conveying the coated material to a developing section by the developing sleeve and developing the developer without contact with the image bearing member and a two-component developing method comprising developing the toner in contact with the image bearing member. From the viewpoint of higher quality and highly stable images, the two-component contact developing method is often used.

Like these, in this embodiment, by setting the toner amount on the image bearing member of toner images for the second surface of a transfer material in double-sided image forming so that $$Mi\times 0.6 \leqq M \leqq Qp(s, k)/Qt(k)/n,$$

where, if Qp (s, k)/Qt (k)/n<Mi×0.6,
then, M=Mi×0.6,
images are well transferred to the second surface without occurrence of a point-shaped transfer defect and high quality images can be obtained on both sides of the transfer material.

Here, as method for measuring the weight per unit area of a toner image on a photosensitive drum, a toner image for a predetermined test (area is known) is formed on a photosensitive drum and the density of this toner image for a predetermined test is sensed with a sensor (light-receiving section). On converting this value of density into a value of weight having a certain fixed correlation, the weight per unit area of the toner image can be evaluated.

Embodiment 8

In Embodiment 7, the toner amount in the second surface of a transfer material is so arranged as to be reduced. From dependence on conditions, however, even paper passed once through a fixing device manifests no such electric characteristics as Curves A and B of FIG. 14 and an ideal electric characteristics like Curve D under some conditions.

Under high temperature and high humidity environment (30° C. and 80% RH), the water content, even if decreased after the pass of a transfer material once through a fixing device, is recovered readily as initially on account of high humidity, so that the electric characteristics of the transfer material manifests a behavior like Curve D. Under such environments, since no point-shaped transfer defect occurs on the second surface, it is unnecessary to reduce the toner amount. Nevertheless, importance of stabilizing the toner amount for securing the density is evident from FIG. 17.

Such being the case, in this embodiment, the maximum retainable surface charge density of the transfer material on the second surface is estimated by making a dummy copy of double-sided image forming on one sheet, the toner amounts of the respective toner images on individual photosensitive drums 403*a* to 403*d* at the time of subsequent double-sided image forming were determined so as to prevent the occurrence of point-shaped poor transfer. Further, a detailed description will be made.

Figure 18:
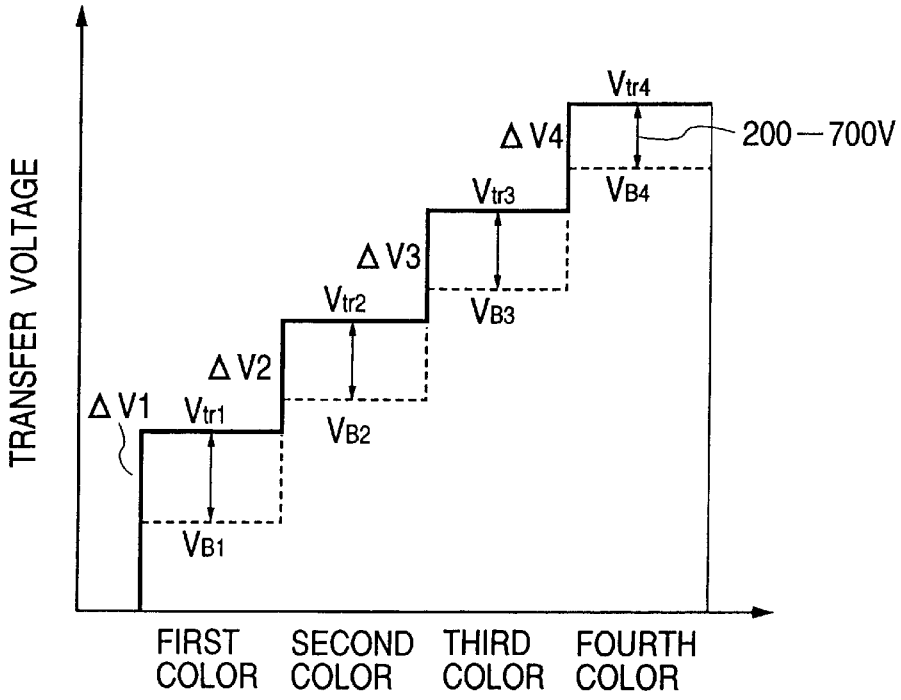
FIG. 18 is a schematic illustration of transfer voltages for individual colors at the transfer to a transfer material.

FIG. 18 shows transfer voltages of individual colors. In FIG. 18, Vtr is a normal transfer voltage and rises each time when color images are superposed on top of each other (in this embodiment, in the sequence of yellow (Y), magenta (M), cyan (C) and black (K)) stepwise to Vtr1, Vtr2, Vtr3 and Vtr4. VB represents changes of transfer voltages in a transfer material not passed and also rises to VB1, VB2, VB3 and VB4 stepwise. From comparison of Vtr with VB, it is found that differences between Vtr and VB for individual colors, ΔV1, ΔV2, ΔV3 and ΔV4, are constant and, though dependent on transfer materials, is normally on the order of 200 to 700V.

Figure 19:
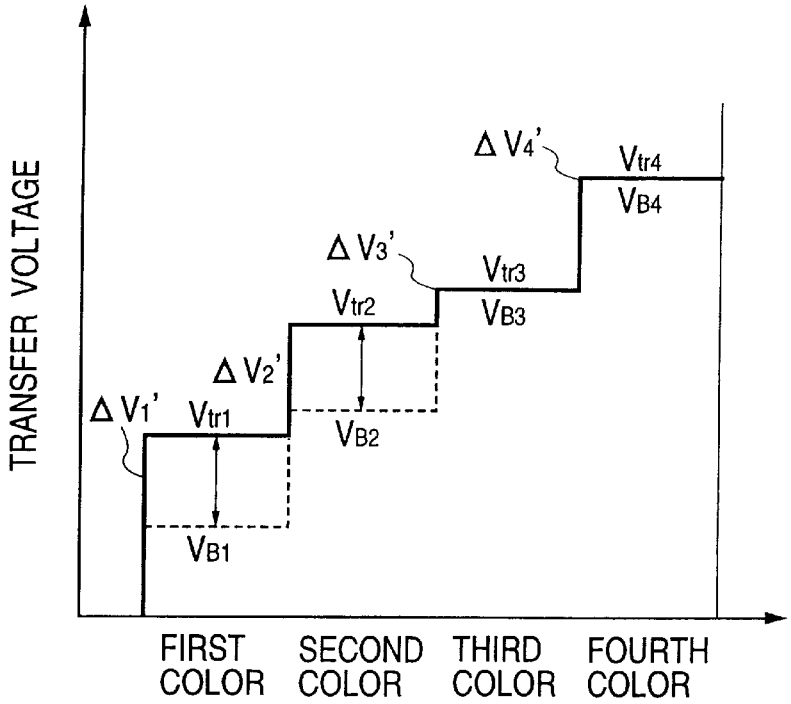
FIG. 19 is a schematic illustration of transfer voltages for individual colors at the transfer to the second surface of a transfer material.

On the other hand, FIG. 19 shows one example of correlation between Vtr and VB at the transfer to the second surface and differences between Vtr and VB for individual colors are designated with ΔV1', ΔV2', ΔV3' and ΔV4'. As clearly seen from these, ΔV1' and ΔV2' are constant, but at the transfer of the third color, Vtr3 abruptly falls to the order of VB3 and the transfer step proceeds as unchanged. Also for the fourth color, ΔV4' is almost 0V and the transfer step has proceeded in a condition of Vtr4=VB4. This is considered because the charge amount supplied to the transfer material exceeds the maximum retainable surface charge density during the progress of transfer for the third color and consequently the transfer impedance abruptly has fallen. Under such circumstances, a point-shaped poor transfer occurs and the image quality is significantly damaged as is mentioned above.

Such being the case, in this embodiment, a double-sided copy of one sheet was made as dummy copy prior to the execution of double-sided copies. After being thoroughly aware of the maximum retainable surface charge density on the second surface of a transfer material, a user is to determine the toner amount on a photosensitive drum at the subsequent double-sided image forming. Hereinafter, a detailed description will be made.

As mentioned above, let ΔV1' to ΔV4' be differentials between Vtr and VB of individual colors on the second surface observed at the time of dummy copy and let Q1, Q2, Q3 and Q4 be charge amounts supplied to a transfer material at the individual color transfers.

When ΔV3' has become nearly 0 at the third color transfer as shown in FIG. 19, for example, the total charge amount supplied to a transfer material till then is Q1+Q2. Accordingly, on dividing the total charge amount Q1+Q2 by the surface area of the transfer material, the maximum retainable surface charge density Qp (s, k) can be computed. Otherwise, as with Embodiment 7, it is advisable to evaluate the toner charge amount per unit weight inferable from the detected value of the temperature/humidity sensor and determine the toner amount per unit area according to the above formula.

Thereby, the hygroscopic degree of the transfer material dependent on the installing environment or the like of an image forming apparatus can be gasped without need for a special arrangement and moreover a point-shaped poor transfer of the second surface in the double-sided image forming can be prevented.

Embodiment 9

This embodiment intends to directly grasp momentarily changing characteristics on the second surface of a transfer material in the double-sided image forming and prevent the occurrence of a poor transfer on the second surface by installing a sensor in the image forming apparatus.

In a transfer material, as mentioned above, since a decrease in water content causes a great change in electric characteristics, a direct detection of its water content permits a correct grasp of its electric characteristics and a correct estimation of its maximum retainable surface charge amount Q.

Then, with this embodiment, an infrared water content meter was provided at a position just before the first color transfer in the apparatus so that the water content of the transfer material can be measured just before the first color transfer, especially just before the first color transfer on the second surface.

And, on the basis of a detected value of the water content meter, the maximum retainable surface charge density on the second surface of the relevant transfer material is estimated referring to FIG. 16 and the toner amount per unit area on the photosensitive drum 3 is determined according to the above formula. Thereby, a point-shaped poor transfer on the second surface, greatly dependent on the installing environment or the like of an image forming apparatus, could be prevented and a good image could be obtained.

In these embodiment, a description was made of an image forming apparatus to sequentially superpose and transfer individual color toner images on photosensitive drum 403*a* to 403*d* onto a transfer material P borne on a transfer belt 530, but needless to say, the present invention is applicable to another image forming apparatus for sequentially forming toner images of two colors or more on a transfer material by sequentially repeating the step of transferring a toner image on a single photosensitive drum.

Besides, the present invention is also applicable to an image forming apparatus equipped with an intermediate transfer member as described in Embodiments 4 to 6.

Embodiment 10

This embodiment will be described based on the image forming apparatus as shown in FIG. 13. This embodiment is so arranged as to control the toner bearing amount corresponding to the left-alone time of a transfer material.

Figure 20:
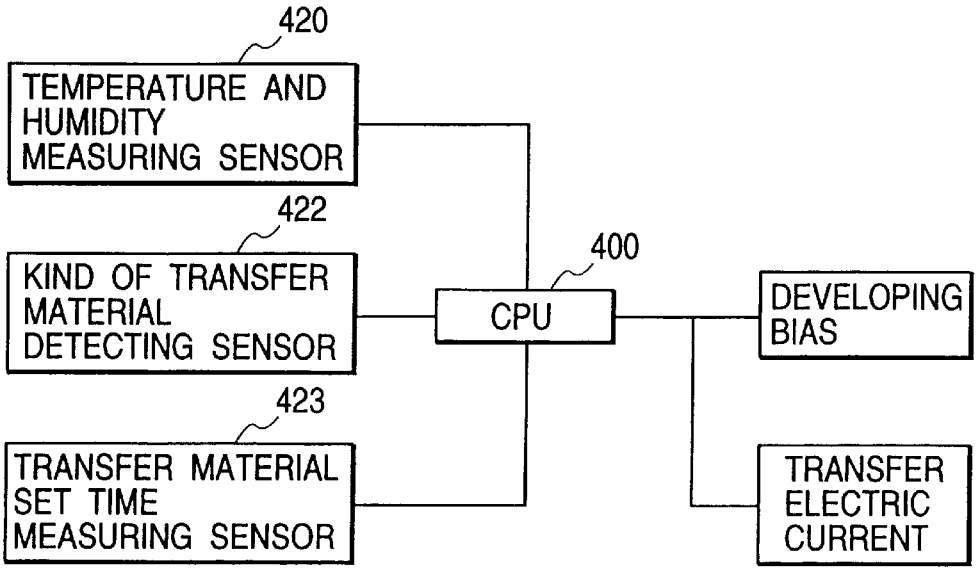
FIG. 20 is a block diagram showing the control system of an image forming apparatus.

In addition to a temperature/humidity sensor 420 for measuring temperature/humidity in the apparatus, as shown in FIG. 20, an image forming apparatus according to this embodiment comprises a transfer material kind detection sensor 422 for detecting kinds of transfer materials P to be stored in a transfer material cassette 410 or the like and a transfer material setting time sensor 423 for measuring the elapsed time from the setting of a transfer material in the transfer material cassette 410 or the like to the image forming thereon.

By controlling a developing bias and a transfer electric current on the basis of information inputted from the temperature/humidity sensor 420, the transfer material kind detection sensor 422 and the transfer material setting time sensor 423, the control device (CPU) 400 changes the maximum toner bearing amount per unit area of a toner image formed on a transfer material P so that the charge amount per unit area of the toner image formed on the transfer material P does not exceed the retainable charge amount per unit area of the transfer material (details will be described later). Besides, the control device (CPU) 400 controls a developing bias, a transfer electric current and such.

Figure 21:
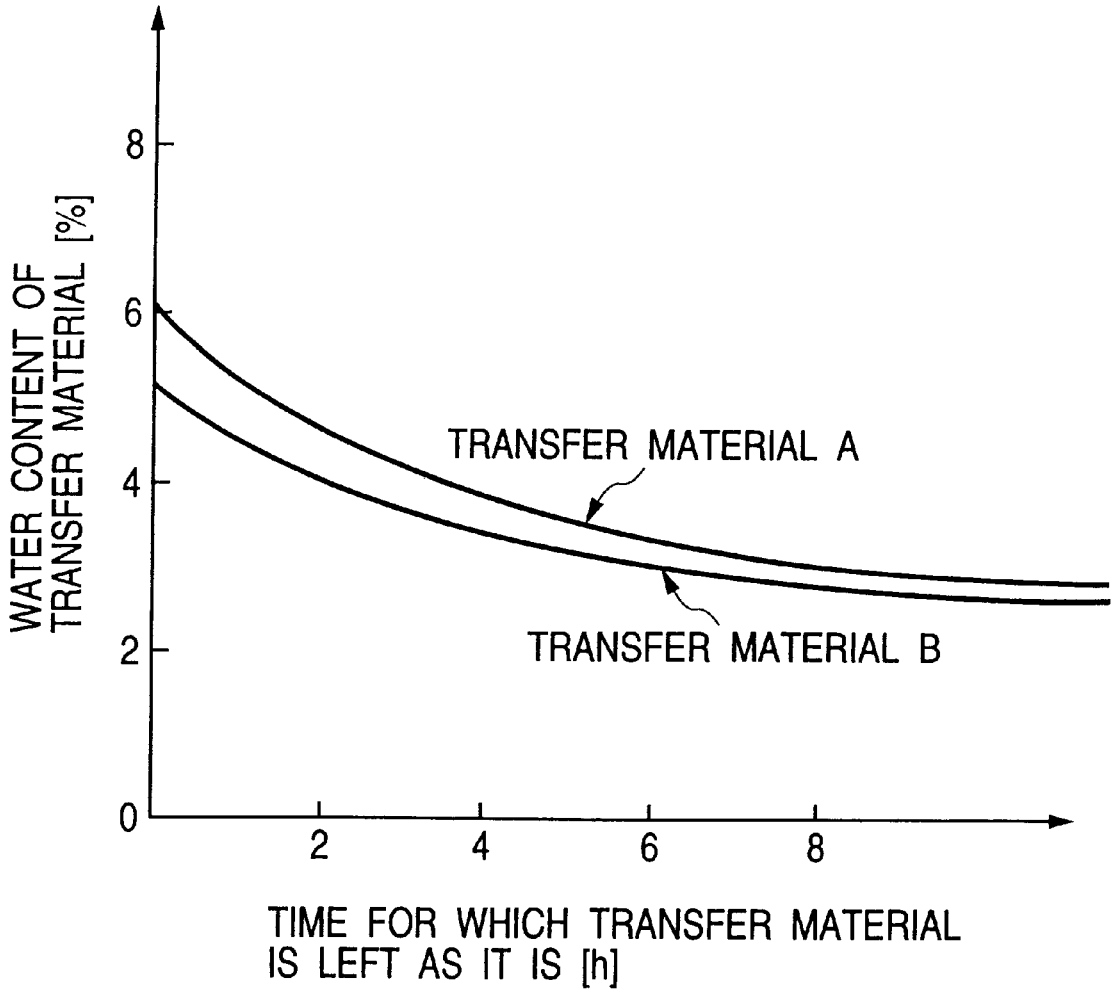
FIG. 21 is a graph showing relations between the left-alone time and the water content of a transfer material.
Figure 22:
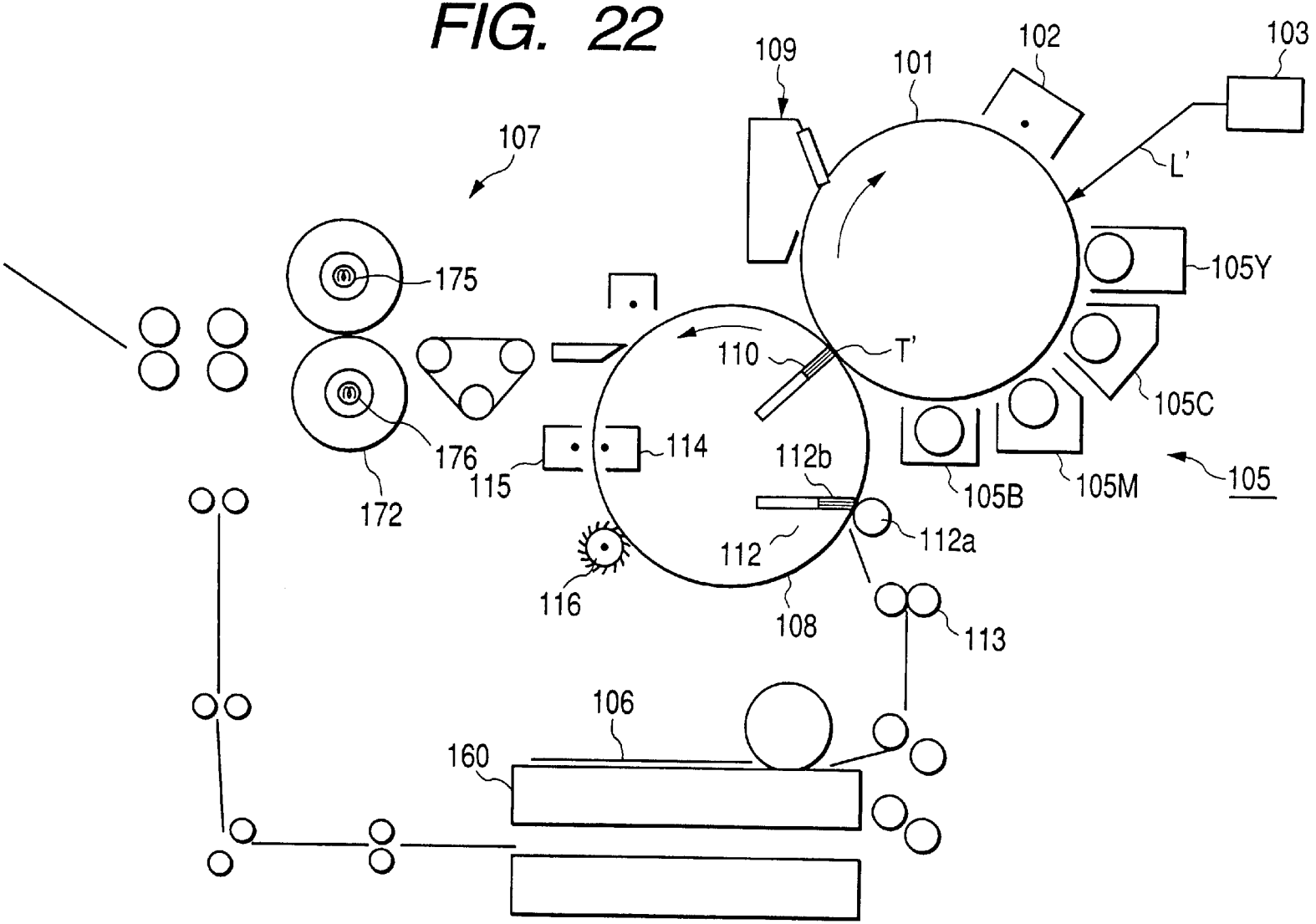
FIG. 22 is a structural view showing a conventional image forming apparatus.
Figure 23:
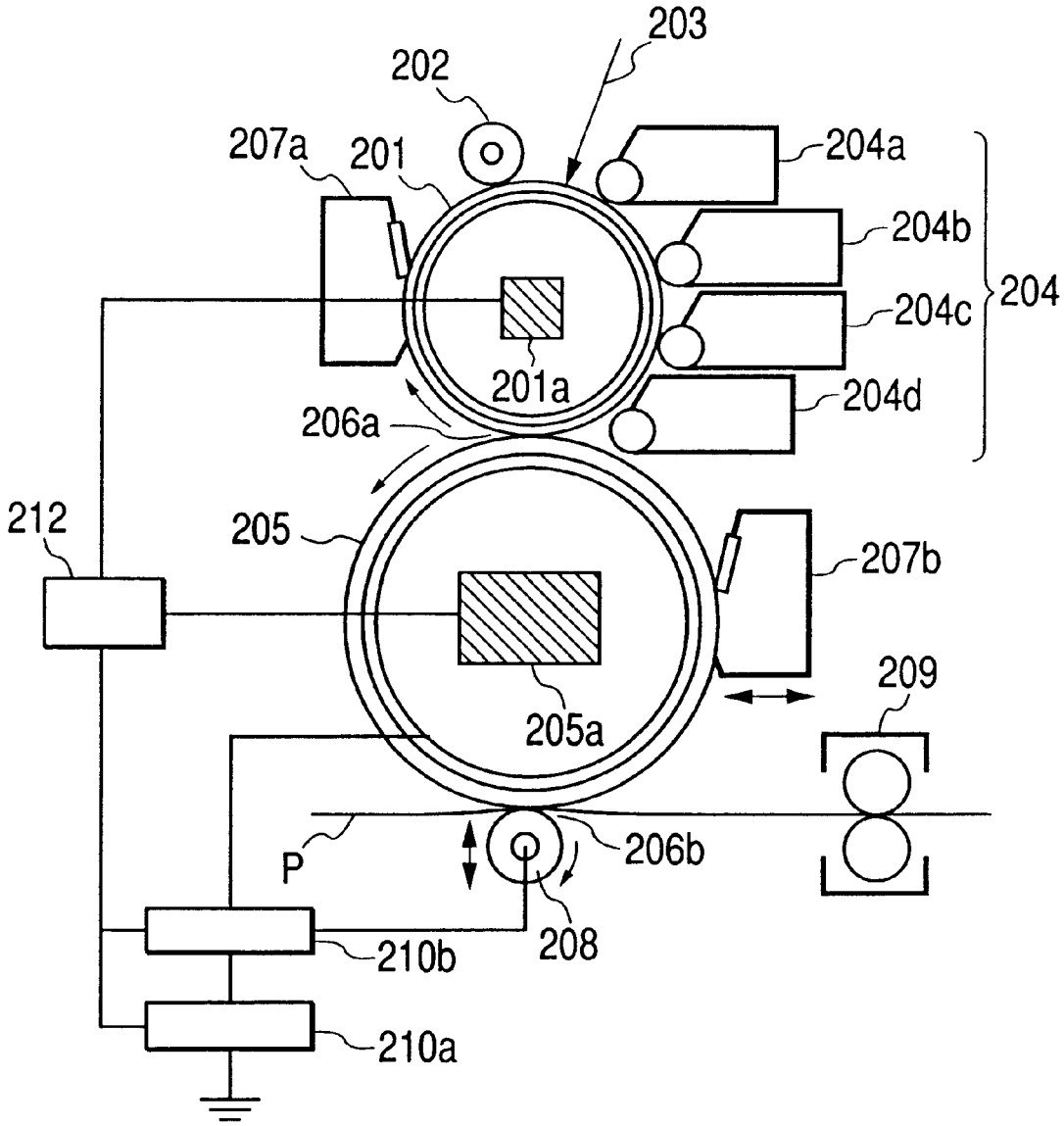
FIG. 23 is a structural view showing another conventional image forming apparatus.

Here, as one example, relations between the left-alone time and the water content of transfer materials are shown in FIG. 21.

Letting Qt (k) (C/kg), M (kg/m$^2$) and Qp (s, k, t) be the charge amount per unit weight of toner developed on a photosensitive drum, the toner bearing amount per unit area and the retainable charge amount per unit area of a transfer material, a value of M is so arranged as to be set which satisfies $$Qp(s, k, t)/Qt(k) \geqq M \quad (2),$$

where k, s and t denote environmental factor, kind of a transfer material and elapsed time from the store of a transfer material into a transfer material cassette, and the environmental factor comprises a temperature, a humidity, an absolute water content, etc.

As mentioned above, paper as one of transfer materials changes in water content, depending upon temperatures and humidities. Thus, with the lapse of time from the opening of a package, the water content changes from that in the package to that under temperature and humidity of the apparatus and with this change, the retainable charge amount Qp per unit area of the transfer material changes. Accordingly, since this time change is slower than the rate of image forming, it becomes effective to detect the left-alone time elapsed from the opening and the setting of paper in the transfer material cassette. That is, under a certain temperature/humidity environment, if paper packed for 500 sheets, for example, is put in the transfer material cassette and used, it takes several hours to several days till 500 sheets of paper is used up. In such a case, paper of the first sheet just after the opening and paper near to the 500th sheet to be used after the lapse of a certain degree of time greatly differ in the retainable charge amount per unit area Qp.

Such being the case, in this embodiment, temperature and humidity in an image forming apparatus is measured by using the temperature/humidity measuring sensor 420 provided therein, shown in FIG. 20, and kinds of transfer materials P to be set in the transfer material cassette 410 or the like are detected by using a transfer material kind detection sensor 422. With respect to kinds of transfer materials P, not only a detection arrangement using the above transfer material kind detecting sensor 422 but an arrangement of user input operating or an arrangement of jointly employing both arrangements is also available.

Furthermore, by using a transfer material setting time measuring sensor 423, the elapsed time from the setting of transfer materials P in the transfer material cassette 410 till a start signal is inputted by a user from the PC through a network or from the display section is measured. In this case, also with respect to the time of setting transfer materials P, not only an arrangement of detection referring to the opening and closing of a transfer material cassette 410 or the like after detecting the exhaustion of transfer materials but an arrangement of user input operating or an arrangement of jointly employing these arrangements is also available.

Besides, with respect to the above opening/closing of a transfer material cassette 410 or the like, since there is also a case of opening/closing by the jam of transfer materials, a discrimination by the joint use of a jam detection device is desirable.

Besides, the charge amount Qt per unit area of toner developed on a photosensitive drum, determined by temperature/humidity environment, kind of a transfer material P and elapsed time from the setting of the transfer material P in a cassette till the formation of images and the retainable charge amount per unit area Qp of the transfer material P are recorded and set beforehand in the memory (ROM) in a control device (CPU) 400.

And, the control device (CPU) 400 inputs individual information items about temperature/humidity environment, kind of a transfer material P and elapsed time from the setting of the transfer material P obtained from the temperature/humidity measuring sensor 420, the transfer material kind detection sensor 422 and the transfer material setting time measuring sensor 423 and determines the charge amount per unit weight Qt of toner developed on the photosensitive drum for the temperature/humidity environment, the kind of the transfer material P and the elapsed time from the setting of the transfer material P and the retainable charge amount per unit area Qp of the transfer material P on the basis of these setting values (normal setting). From these Qt and Qp determined, the maximum value of the toner bearing amount per unit area is determined according to the above formula (2).

If the maximum value M1 of the toner bearing amount per unit area determined thus is smaller than the initial setting value M0, the toner bearing amount per unit area is reduced to the determined maximum value M1.

Or else if greater than the initial setting value M0, the toner bearing amount per unit area is brought sufficiently near to the selected maximum value M1 from the setting value within the upper limit of 20 g/m$^2$. If the maximum value M1 of the toner bearing amount per unit area exceeds 20 g/m$^2$, however, the toner bearing amount per unit area is set to 20 g/m$^2$.

Besides, the lower limit of the toner bearing amount per unit area is set to 60% of the maximum value of the toner bearing amount of the standard setting value, i.e. 12 g/m$^2$. The maximum value of the toner bearing amount according to the above formula (2), if lower than this value, is set to 12 g/m$^2$ from the viewpoint of securing the density. However, it is not always necessary to set up the lower limit, or the lower limit can be set up separately.

As means for changing the above toner bearing amount per unit area in the above case, means for making Vcont variable as with the foregoing embodiment was used under control of a control device (CPU) 400 in this embodiment.

Or, as with the above embodiments, a value of transfer electric current may be variably controlled corresponding to the toner bearing amount of a toner image formed on a photosensitive drum (temperature/humidity and kind of paper).

Hereinafter, referring to specific examples, a description will be made. Under low humidity environment (temperature of 23° C. and humidity of 5%) after a sufficient lapse of time from the setting of the above transfer materials A and P, for example, the charge amount per unit weight Qt of toner developed on individual photosensitive drums 403*a*, 403*b*, 403*c* and 403*d* is $30\times10^{-3}$ C/kg and the retainable charge amount per unit area Qp of the transfer material P is $500\times10^{-6}$ C/m$^2$. Thus, since the toner bearing amount per unit area M becomes 16.7 g/m$^2$ (1.67 mg/cm$^2$), the toner bearing amount is decided to reduce by 13.5% from the preset standard setting value.

In this case, the bearing amount of a monochrome tone image is 8.3 g/m$^2$ and the above electric potential Vcont required for this is so controlled as to lower from 430V, preset setting value, to 400V.

At this time, the above Vback (=Vdc−Vd), V1, Vd and Vdc are 130V, −120V, −680V and −550V, respectively.

Besides, the elapsed time till reducing the toner bearing amount per unit area is changed depending on the time of setting a transfer material in a transfer material cassette 410. Besides, with respect to the above transfer material A as kind of a transfer material, the bearing amount is set so as to be gradually changed at intervals of 12 hr and as to be reduced by 13.5% from the standard setting value after the lapse of 48 hr. Since this time change depends upon kinds of transfer materials, it is desired that different setting can be made depending on kinds of transfer materials.

Besides, concerning a way to change the toner bearing amount per unit area, more specifically, when a red image is formed, for example, monochrome solid toner images are multiply transferred in the sequence of yellow and magenta in this embodiment (the sequence of image formation in an image forming apparatus according to this embodiment comprises yellow, magenta, cyan and black), while the maximum value M of the toner bearing amount on a transfer material has only to be equally divided into halves for each color toner.

Namely, it is only necessary to set the bearing amount of yellow toner to be developed first to 8.3 g/m$^2$ and that of magenta toner to be developed secondly to 8.3 g/m$^2$. Here, the maximum bearing amount per unit area of a single toner used alone is allotted to that of yellow toner and that of magenta toner at the ratio of ½, but that of magenta may be arranged as to be greater than that of yellow considering a greater tendency of counter-transfer for the toner layer formed at the upper layer of a transfer material P in case of forming, for example, the red image.

Besides, in the above embodiments, a case of reducing the toner bearing amount to as great extent as 13.5% was described, but if this extent of reduction is slight, e.g. on the order of 2 to 4%, an arrangement may be taken in which only the toner bearing amount of yellow forming a toner image at the lowermost layer is reduced.

Like this, lowering the maximum toner bearing amounts per unit area of individual colors by referring to individual information items about temperature/humidity environment, kind of a transfer material and elapsed time from the setting of the transfer material in a cassette, prevented a counter-transfer in which the tone image transferred once from a photosensitive drum to a transfer material is transferred with a transfer nip from on the transfer material to the photosensitive drum during the progress of multiple transfer, thus making a stable multiple transfer implementable.

Embodiment 11

This embodiment also comprises an image forming apparatus and a control system as shown in FIG. 13 and FIG. 20, respectively. In this embodiment, a value of transfer electric current alone is so arranged as to be changed without any change in maximum toner bearing amount per unit area unlike Embodiment 10.

When a transfer electric current alone is lowered without reduction of toner bearing amount, the efficiency of transfer falls. To be specific, when such an amount of toner by which any image faults do not occur is transferred from photosensitive drums 403*a*, 403*b*, 403*c* and 403*d* to a transfer material P, the toner not transferred remains on the photosensitive drums 403*a*, 403*b*, 403*c* and 403*d*. In this case, since the load of cleaning the photosensitive drums by using cleaning devices 404*a*, 404*b*, 404*c* and 404*d* increases, a fear arise of poor cleaning, but there is a merit that the arrangement can be made the simpler because of no need for making the above Vcont variable if a sufficient cleaning power is secured.

The optimal transfer electric current in this case must be different from a value of transfer electric current observed when the toner bearing amount is changed as with Embodiment 10.

Like this, also in this embodiment, a counter-transfer is prevented in which the toner image transferred once from a photosensitive drum to a transfer material is transferred again with a transfer nip from on the transfer material to the photosensitive drum during the progress of multiple transfer, thus making a stable multiple transfer implementable as with Embodiment 10.

Besides, in each of these embodiments, a tandem image forming apparatus for accomplishing the forming of a full-color image by four photosensitive drums and one transfer belt was described, but needless to say, the present invention is also applicable to others, for example, to a multiple transfer image forming apparatus for accomplishing the forming of a full-color image by four developing devices disposed around a single photosensitive drum and one transfer drum.

Besides, the present invention is also applicable to an image forming apparatus provided with an intermediate transfer member like the above embodiment.

Even an appropriate combination of Embodiments 1 to 11 described above never departs from the idea of the present invention.

Besides, except Embodiments 1 to 11, various modifications may be resorted to in so far as the operating effect of the present invention is obtained.

What is claimed is:

1. An image forming apparatus comprising:

an image bearing member;

image forming means for forming an electrostatic latent image including an image portion and a non-image portion on said image bearing member;

developing means for developing the electrostatic latent image on said image bearing member with toner;

transfer means for electrostatically transferring a toner image on said image bearing member to a transfer material;

detecting means for detecting environmental humidity; and control means for controlling a difference between an electric potential of the image portion and a voltage to be applied to said developing means to alter a toner amount per unit area of the toner image on said image bearing member in accordance with an output of said detecting means, wherein said control means controls the difference between the electric potential of the image portion and the voltage to be applied to said developing means so that the toner amount per unit area of the toner image decreases with decreasing values of environmental humidity detected by said detecting means.

2. The image forming apparatus according to claim 1, wherein said control means alters the toner amount per unit area of the toner image formed by said image forming means on said image bearing member in accordance with a kind of the transfer material.

3. The image forming apparatus according to claim 2, further comprising transfer material detecting means for detecting the kind of the transfer material, wherein said control means alters the toner amount per unit area of the toner image on said image bearing member in accordance with an output of said transfer material detecting means.

4. The image forming apparatus according to claim 1, wherein said control means alters the toner amount per unit area of the toner image on said image bearing member lest the toner amount does not become greater than a predetermined upper limit.

5. The image forming apparatus according to claim 4, wherein said control means alters the toner amount per unit area of the toner image on said image bearing member lest the toner amount does not become smaller than a predetermined lower limit.

6. The image forming apparatus according to claim 1, wherein said image forming means comprises charging means for charging said image bearing member, and exposure means for exposing a surface of said image bearing member, charged by said charging means, to form the electrostatic latent image including the image portion and the non-image portion.

7. The image forming apparatus according to claim 6, wherein said control means controls an exposure amount by said exposure means.

8. The image forming apparatus according to claim 6, wherein said control means controls a direct current voltage applied to said developing means.

9. An image forming apparatus according to claim 8, wherein in developing, the voltage in which a direct current voltage and an alternating current voltage are superimposed on each other is applied to said developing means.

10. The image forming apparatus according to claim 6, wherein said control means controls a direct current voltage applied to said charging means.

11. An image forming apparatus according to claim 10, wherein, in charging, the voltage in which a direct current voltage and an alternating current voltage are superimposed on each other is applied to said charging means.

12. The image forming apparatus according to claim 1, wherein said control means controls a transfer condition to alter the toner amount per unit area of the toner image on the transfer material in accordance with the output of said detecting means.

13. The image forming apparatus according to claim 1, further comprising density detecting means for detecting a density of the toner image formed on said image bearing member, wherein said control means alters the toner amount per unit area of the toner image on said image bearing member, in accordance with an output of said density detecting means.

14. An image forming apparatus according to claim 1, wherein said transfer means comprises a transfer material bearing member for bearing the transfer material and the toner image on said image bearing member is electrostatically transferred to the transfer material borne by said transfer material bearing member.

15. An image forming apparatus according to claim 14, wherein toner images different in color from each other are sequentially transferred from said image bearing member and superimposed onto the transfer material borne by said transfer material bearing member.

16. An image forming apparatus according to claim 14, comprising a plurality of image bearing members, wherein toner images different in color from each other are sequentially transferred from respective image bearing members and superimposed onto the transfer material borne by said transfer material bearing member.

17. An image forming apparatus according to claim 1, wherein said transfer means comprises an intermediate transfer member, and wherein the toner image is transferred from said image bearing member onto said intermediate transfer member and the toner image transferred onto said intermediate transfer member is transferred onto the transfer material.

18. An image forming apparatus according to claim 17, wherein toner images different in color from each other are sequentially transferred from said image bearing member and superimposed onto said intermediate transfer member, and the plural color toner images transferred onto said intermediate transfer member are transferred onto the transfer material.

19. An image forming apparatus according to claim 17, comprising a plurality of image bearing members, wherein toner images different in color from each other are sequentially transferred from respective image bearing members and superimposed onto said intermediate transfer member, and the plural color toner images transferred onto said intermediate transfer member are transferred onto the transfer material.

20. An image forming apparatus according to claim 17, wherein said control means controls a primary-transfer condition and a secondary-transfer condition to alter the toner amount per unit area of the toner image on the transfer material in accordance with the output of said detecting means.

21. An image forming apparatus according to claim 1, wherein said control means controls said difference to alter a maximum value of the toner amount per unit area of the toner image on said image bearing member in accordance with the output of said detecting means.

22. An image forming apparatus according to claim 21, wherein said control means controls the difference between the voltage to be applied to said developing means and the electric potential of the image portion for obtaining the toner image having a maximum density.

23. An image forming apparatus according to claim 1, wherein said detecting means detects temperature and relative humidity of an ambience.

24. An image forming apparatus according to claim 23, further comprising calculating means for calculating an absolute water content based on the output of said detecting means.

25. An image forming apparatus comprising:

an image bearing member;

image forming means for forming an electrostatic latent image on said image bearing member;

developing means for developing the electrostatic latent image on said image bearing member with toner;

transfer means for electrostatically transferring a toner image on said image bearing member to a transfer material;

detecting means for detecting environmental humidity; and control means for controlling a difference between an electric potential of an image portion of the electrostatic latent image on said image bearing member and a voltage to be applied to said developing means to alter a toner amount per unit area of the toner image on the transfer material in accordance with an output of said detecting means, wherein said control means controls the difference between the electric potential of the image portion and the voltage to be applied to said developing means so that the toner amount per unit area of the toner image decreases with decreasing values of environmental humidity detected by said detecting means.

26. An image forming apparatus according to claim 25, wherein said control means controls said difference to alter the toner amount per unit area of the toner image on the transfer material in accordance with a kind of the transfer material.

27. An image forming apparatus according to claim 26, further comprising transfer material detecting means for detecting the kind of the transfer material, wherein said control means controls said difference to alter the toner amount per unit area of the toner image on the transfer material in accordance with an output of said transfer material detecting means.

28. An image forming apparatus according to claim 25, further comprising calculating means for calculating an absolute water content based on the output of said detecting means.

29. An image forming apparatus according to claim 25, wherein said control means alters the toner amount per unit area of the toner image on the transfer material lest the toner amount does not become greater than a predetermined upper limit.

30. An image forming apparatus according to claim 25, wherein said control means alters the toner amount per unit area of the toner image on the transfer material lest the toner amount does not become smaller than a predetermined lower limit.

31. An image forming apparatus according to claim 25, wherein said image forming means comprises charging means for charging said image bearing member, and exposure means for exposing a surface of said image being member, charged by said charging means, to form the electrostatic latent image including the image portion and a background portion.

32. An image forming apparatus according to claim 31, wherein said control means controls a direct current voltage applied to said developing means.

33. An image forming apparatus according to claim 32, wherein, in developing, the voltage in which the direct current voltage and an alternating current voltage are superimposed on each other is applied to said developing means.

34. An image forming apparatus according to claim 31, wherein said control means controls a direct current voltage applied to said charging means.

35. An image forming apparatus according to claim 34, wherein, in charging, the voltage in which the direct current voltage and an alternating current voltage are superimposed on each other is applied to said charging means.

36. An image forming apparatus according to claim 31, wherein said control means controls an exposure amount by said exposure means.

37. An image forming apparatus according to claim 31, wherein said control means controls said difference to alter a maximum value of the toner amount per unit area of the toner image on said image bearing member in accordance with the output of said detecting means.

38. An image forming apparatus according to claim 37, wherein said control means controls the difference between the voltage to be applied to said developing means and the electric potential of the image portion for obtaining the toner image having a maximum density.

39. An image forming apparatus according to claim 25, wherein said control means controls a transfer condition to alter the toner amount per unit area of the toner image on the transfer material in accordance with the output of said detecting means.

40. An image forming apparatus according to claim 25, wherein said control means controls said difference to alter a maximum value of the toner amount per unit area of the toner image on said image bearing member in accordance with the output of said detecting means.

* * * * *

UNITED STATES PATENT AND TRADEMARK OFFICE

CERTIFICATE OF CORRECTION

PATENT NO. : 6,529,693 B2
DATED : March 4, 2003
INVENTOR(S) : Takeshi Tomizawa et al.

It is certified that error appears in the above-identified patent and that said Letters Patent is hereby corrected as shown below:

Column 1,
Line 17, “electrophoto graphic” should read -- electrophotographic --.

Column 2,
Line 24, “htransferred” should read -- transferred --; and
Line 32, “permanent,image” should read -- permanent image --.

Column 3,
Line 44, “marks,of” should read -- marks of --.

Column 5,
Line 14, “deflectes” should read -- deflects --;
Line 16, “is:” should read -- is --; and
Line 38, “body;of” should read -- body of --.

Column 6,
Line 14, “suchlike” should read -- such like --; and
Line 43, “After” should read -- After being --; and “eliminator” should read -- eliminators --.

Column 7,
Line 37, “image,is” should read -- image is --;
Line 48, “Accordingly,:” should read -- Accordingly, --; and
Line 61, “from;” should read -- from --.

Column 10,
Line 53, “denote” should read -- denotes --; and
Line 60, “differentials” should read -- differential --.

Column 12,
Line 20, “copy” (second occurrence) should read -- copying --; “Read” should read -- Reading --; and
Line 32, “a” should be deleted.

Column 14,
Line 26, “eredithat” should read -- ered that --.

UNITED STATES PATENT AND TRADEMARK OFFICE

CERTIFICATE OF CORRECTION

PATENT NO. : 6,529,693 B2
DATED : March 4, 2003
INVENTOR(S) : Takeshi Tomizawa et al.

It is certified that error appears in the above-identified patent and that said Letters Patent is hereby corrected as shown below:

Column 18,
Line 49, “charger” should read -- chargers --;
Line 50, “voltmeter” should read -- voltmeters --; and
Line 66, “toner” should read -- toners --.

Column 19,
Line 66, “roller” should read -- rollers --.

Column 21,
Line 40, “passed” should read -- passing --.

Column 23,
Line 49, “preferable” should read -- preferably --.

Column 25,
Line 53, “characteristics” should read -- characteristic --.

Column 26,
Line 17, “is” should read -- are --; and
Line 61, “gasped” should read -- grasped --.

Column 27,
Line 25, “these” should read -- this --; and
Line 27, “drum” should read -- drums --.

Column 28,
Line 32, “is” should read -- are --.

Column 30,
Line 57, “arise” should read -- arises --; and
Line 58, “the” should be deleted.

Column 32,
Line 52, “comprising” should read -- further comprising --.

UNITED STATES PATENT AND TRADEMARK OFFICE

CERTIFICATE OF CORRECTION

PATENT NO. : 6,529,693 B2
DATED : March 4, 2003
INVENTOR(S) : Takeshi Tomizawa et al.

It is certified that error appears in the above-identified patent and that said Letters Patent is hereby corrected as shown below:

Column 33,
Line 5, “comprising” should read -- further comprising --.

Column 34,
Line 23, “being” should read -- bearing --.

Signed and Sealed this

Second Day of December, 2003

JAMES E. ROGAN
*Director of the United States Patent and Trademark Office*